US012078030B2

(12) United States Patent
Naveena-Chandran

(10) Patent No.: US 12,078,030 B2
(45) Date of Patent: Sep. 3, 2024

(54) OLEOPHOBIC AND HYDROPHOBIC APPLICATIONS FOR DOWNHOLE TOOLS

(71) Applicant: Halliburton Energy Services, Inc., Houston, TX (US)

(72) Inventor: Rohin Naveena-Chandran, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/198,162

(22) Filed: May 16, 2023

(65) Prior Publication Data

US 2024/0191602 A1 Jun. 13, 2024

Related U.S. Application Data

(60) Provisional application No. 63/430,728, filed on Dec. 7, 2022.

(51) Int. Cl.
*E21B 37/06* (2006.01)

(52) U.S. Cl.
CPC ..... *E21B 37/06* (2013.01)

(58) Field of Classification Search
CPC ..... E21B 17/00
See application file for complete search history.

(56) References Cited

U.S. PATENT DOCUMENTS 7,650,937 B2 1/2010 Fox et al.
2012/0273282 A1 11/2012 Lin et al.
2013/0032411 A1* 2/2013 John ..... E21B 17/028 175/320
2015/0240146 A1 8/2015 Sista et al.
2016/0090824 A1 3/2016 Overstreet et al.
2018/0038206 A1 2/2018 Banerjee et al.

FOREIGN PATENT DOCUMENTS

WO 2007039758 4/2007

OTHER PUBLICATIONS

International Search Report and Written Opinion for International Patent Application No. PCT/US2023/024131 dated Sep. 20, 2023.
Aculon, AcuFlow Treatment Instructions, Available at www.aculon.com, Accessed May 15, 2023.
Aculon, Sapphire Treatment Instructions, Available at www.aculon.com, Accessed May 15, 2023.
Constien and Associates Laboratory Report, Friction Reducer Testing, Jul. 19, 2022.

(Continued)

*Primary Examiner* — William D Hutton, Jr.

(74) *Attorney, Agent, or Firm* — John W. Wustenberg; C. Tumey Law Group, PLLC

(57) ABSTRACT

A variety of methods are disclosed, including, in one embodiment, a method comprising: applying a wettability modifier coating on a surface of a downhole tool; disposing the downhole tool into a wellbore extending into a subterranean formation, wherein the wettability modifier coating is disposed on the surface of the downhole tool; traversing the wellbore with the downhole tool; and removing the downhole tool from the wellbore.

19 Claims, 10 Drawing Sheets

(56) References Cited

OTHER PUBLICATIONS

Aculon, Working from Home, Webinar Series: Anti Fingerprint Solutions, 2020.
Aculon, Safety Data Sheet, AcuFlow Wipes, Aug. 22, 2022.
Aculon, Nano Surface Modification Technologies for the Energy Space, Available at www.aculon.com, Accessed May 15, 2023.
Aculon, Safety Data Sheet, Aculon Cleaner 907, Jun. 12, 2018.
Aculon, AcuFlow Nano Treatment, Surface Modification Technologies for O&G Applications, Available at www.aculon.com, Accessed May 15, 2023.
Halliburton, Rohin Naveena-Chandran, Oleophobic and Hydrophobic applications for wireline technologies, Nov. 16, 2022.

* cited by examiner

OLEOPHOBIC AND HYDROPHOBIC APPLICATIONS FOR DOWNHOLE TOOLS

CROSS-REFERENCE TO RELATED APPLICATIONS

The present application claims priority of U.S. Patent Application No. 63/430,728 filed Dec. 7, 2022, the entire disclosure of which is incorporated herein by reference.

BACKGROUND

Wells may be drilled at various depths to access and produce oil, gas, minerals, and other naturally occurring deposits from subterranean geological formations. The drilling of a well is typically accomplished with a drill bit that is rotated within the well to advance the well by removing topsoil, sand, clay, limestone, calcites, dolomites, or other materials. These materials are typically recirculated to a terrestrial surface during drilling and separated prior to being reintroduced to a borehole.

During or after drilling operations, sampling operations may be performed to collect a representative sample of formation or reservoir fluids (e.g., hydrocarbons) to further evaluate drilling operations and production potential, or to detect the presence of certain gases or other materials in the formation that may affect well performance.

During sampling operations, a downhole tool or fluid sampling tool may be lowered into a wellbore or borehole on a tool string or wireline, wherein the tool may interact with wellbore fluids and/or reservoir fluids. These wellbore fluids and/or reservoir fluids may pose problems as they may contain materials or compounds which stick to the tools, thereby creating sampling challenges, among other problems. For example, when running downhole tools in a wellbore, wellbore fluids, reservoir fluids, and sands may stick to the tools, adhere to lenses, clog up internal regions of the tools, create drag during lowering or raising of the tool in the wellbore, and interfere with measurements.

BRIEF DESCRIPTION OF THE DRAWINGS

These drawings illustrate certain aspects of some of the embodiments of the present disclosure, and should not be used to limit or define the disclosure.

DETAILED DESCRIPTION

Figure 1:
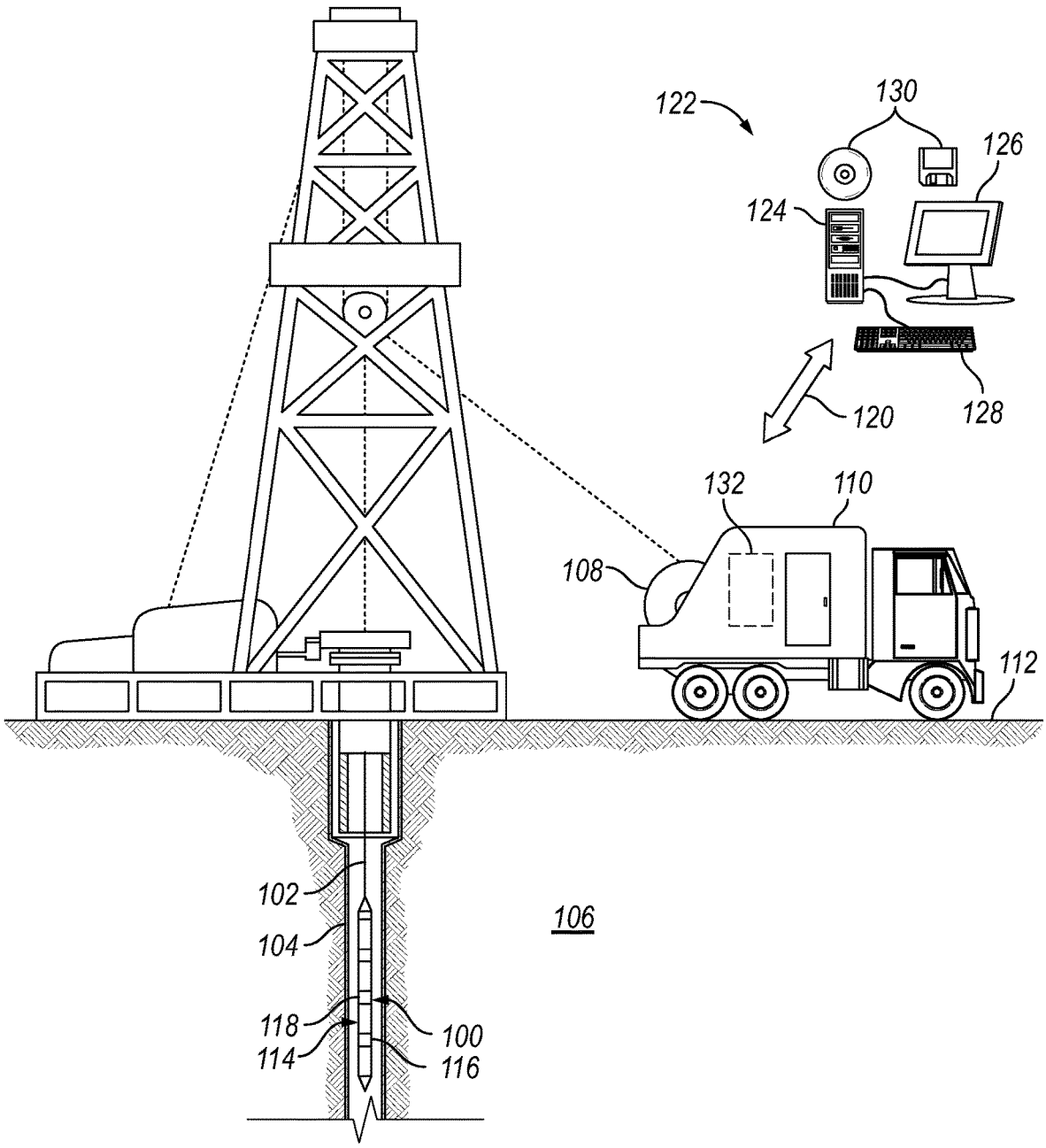
FIG. 1 illustrates a schematic view of a well in which an example embodiment of a fluid sample system is deployed.

The present disclosure relates to methods and systems to repel unwanted fluids at a molecular level using a wettability modifier coating, such as an oleophobic or hydrophobic coating. More particularly, the present disclosure relates to a wettability modifier coating applied to internal and/or external surfaces of a downhole tool or tool string.

Advantages of the present application include an improved ability to mitigate problems caused by sticking of wellbore fluids, reservoir fluids, and/or sand to internal and external surfaces of downhole tools and tool strings. For example, certain embodiments according to the present disclosure may be suitable for reducing an amount of drag exerted by a wellbore fluid on a downhole tool or tool string disposed in a wellbore. In some examples, the amount of time required to clean a downhole tool or tool string may be significantly reduced. Another advantage is that adhesion of unwanted fluids, including water, oil, and other hydrophobic materials, to surfaces may be reduced or prevented. In some examples, both oleaginous fluids and aqueous fluids may be repelled from surfaces by a wettability modifier coating with the methods and systems disclosed herein.

Other advantages may include increased fluid velocity through a downhole tool, such as through conduits and passageways disposed therein, as well as anti-smudging, anti-fouling, anti-fog, and/or self-cleaning capabilities. For example, optically transparent or semi-transparent lenses having a wettability modifier coating in accordance with certain embodiments of the present disclosure disposed thereon may allow for more accurate readings of sampled fluids.

Wettability modifier coatings may generally include an oleophobic coating, a hydrophobic coating, or a coating that is both oleophobic and hydrophobic. Alternatively, wettability modifier coatings may comprise a single coating or multiple coatings, such as one or more hydrophobic coatings layered on top of or disposed between one or more oleophobic coatings. For example, in single coating examples, a wettability modifier coating may have both oleophobic and hydrophobic properties.

The fluids described herein may comprise, without limitation, aqueous fluids, oleaginous fluids, wellbore fluids, reservoir fluids, brines, fresh water, salt water, water from any source, wellbore treatment fluids, drilling muds, such as muds comprising aqueous or oleaginous base fluids, emulsions, invert emulsions, spacer fluids, production fluids, injection fluids, hydraulic fracturing fluid, enhanced oil recovery fluids, SAGD well fluids, fracturing fluids, proppants, cementing fluids, spacer fluids, injection fluids, clays, sands, fouling materials, production fluids, seawater, any species dissolved or suspended therein (e.g., low density solids, high density solids, etc.), and any combinations thereof. The fluids may comprise any chemical species commonly or uncommonly present in a wellbore during drilling, oil production, cementing, hydraulic fracturing, and/or any operation involving drilling into a subterranean formation and/or production of hydrocarbons in a hydrocarbon-bearing subterranean reservoir.

Aqueous fluids may generally include water and, optionally, one or more species dissolved or suspended therein. Oleaginous fluids may refer to any fluid comprising a carbonaceous compound at a significant concentration, such as carbonaceous compounds selected from an alkane, an olefin, an aromatic organic compound, a cyclic alkane, a paraffin, a diesel fluid, a mineral oil, crude oil, synthetic oil, petroleum, kerosene, gas oil, fuel oil, a polyolefin, asphaltenes, carboxylates, esters, natural oils, naphthene, naphthenic hydrocarbons, fatty acids, alcohols, cycloparaffin compounds, other hydrocarbons, the like, and/or combinations thereof.

The fluids described herein may further comprise polar compounds, such as asphaltenes, carboxylates, organic foulants, natural organic foulants, synthetic foulants, hydrocarbon foulants, humic acids, etc., that, upon exposure to one or more untreated surfaces, would adhere to, foul, deposit to, or otherwise interfere with movement of fluids across surfaces if not for a wettability modifier. Such fluids may additionally interfere with sensing by one or more sensors (e.g., sensors measuring absorption, transmittance, reflectance spectra, etc.) and/or interfere with fluid sampling.

A downhole tool may generally include a body. A downhole tool may, in certain examples, further include conduits and/or means disposed therein to sample, measure, transport, and/or store fluids, such as to obtain sensor measurement data corresponding to one or more fluid properties. A downhole tool may also include a conveyance. Wettability modifier coatings according to the present disclosure may be disposed on one or more surfaces of a downhole tool and/or tool string, including, for example, external surfaces and/or internal surfaces thereof, to be elaborated upon later in detail. For example, it may be desirable in certain examples to apply to a surface of a downhole tool one or more wettability modifier coatings in accordance with the present disclosure when, for example, the downhole tool comprises one or more sensors or sensing regions. Wettability modifier coatings according to certain examples may reduce a total number of active adsorption sites per area of a surface upon to which it is applied relative to the same untreated surface.

Wettability modifier coatings in accordance with the present disclosure may, in certain examples, decrease a total amount of fluid adsorbate adherable to a surface by more than one of about 5%, about 20%, about 50%, about 60%, about 70%, or 80%, or any ranges therebetween as compared to the amount of fluid adsorbate adherable to the same surface without the wettability modifier coating applied thereto. In some examples, the wettability modifier coating may reduce a total amount of drag (e.g., fluid friction) exerted on at least a portion of the downhole tool by an internal or external fluid by at least 5%, at least 10%, at least 20%, at least 30%, at least 50%, or at least 80% as compared to the portion of the downhole tool without the wettability modifier coating.

Wettability modifier coatings in accordance with the present disclosure may comprise liquids, vapors, and/or solids. For example, a wettability modifier coating may be in a liquid or vapor phase prior to application to a surface of a downhole tool but, upon application thereto, solidify and form a film, residue, or coating. To further illustrate, FIGS. 1-11 are provided and give examples of downhole wellbore equipment surface to which these wettability modifier coatings may be applied, as well as their methods of application. It should be understood that these illustrations are exemplary and are not meant to limit the scope of the disclosure to specific tools or specific surfaces shown.

As illustrated in FIGS. 1-11, systems and methods for using a wettability modifier coating may be provided. The systems and methods may include one or all of the components illustrated on FIGS. 1-11. It should be noted that, while FIGS. 1-11 generally depict land-based systems, the principles described herein are equally applicable to subsea drilling operations that employ floating or sea-based platforms and rigs, without departing from the spirit and scope of the disclosure.

FIG. 1 is a schematic diagram of downhole tool 100 on a conveyance 102. As illustrated, wellbore 104 may extend through subterranean formation 106. In examples, reservoir fluid may be contaminated with well fluid (e.g., drilling fluid) from wellbore 104. As described herein, one or more fluid samples may be analyzed to determine fluid contamination and other fluid properties of the reservoir fluid. As illustrated, a wellbore 104 may extend through subterranean formation 106. While the wellbore 104 is shown extending generally vertically into the subterranean formation 106, the principles described herein are also applicable to wellbores that extend at an angle through the subterranean formation 106, such as horizontal and slanted wellbores. For example, although FIG. 1 shows a vertical or low inclination angle well, high inclination angle or horizontal placement of the well and equipment is also possible.

As illustrated, a hoist 108 may be used to run downhole tool 100 into wellbore 104. Hoist 108 may be disposed on vehicle 110. Hoist 108 may be used, for example, to raise and lower conveyance 102 in wellbore 104. While hoist 108 is shown on vehicle 110, it should be understood that conveyance 102 may alternatively be disposed from a hoist 108 that is installed at surface 112 instead of being located on vehicle 110. Downhole tool 100 may be suspended in wellbore 104 on conveyance 102. Other conveyance types may be used for conveying downhole tool 100 into wellbore 104, including coiled tubing and wired drill pipe, for example. Downhole tool 100 may comprise a tool body 114, which may be elongated as shown on FIG. 1. Tool body 114 may be any suitable material, including without limitation titanium, Inconel, a nickel-chromium-based superalloy, a chromium alloy, a nickel alloy, stainless steel, alloys, plastic, combinations thereof, and the like. Downhole tool 100 may further include one or more sensors 116 for measuring properties of the fluid sample, reservoir fluid, wellbore 104, subterranean formation 106, or the like. In one or more examples, downhole tool 100 may comprise a fluid sampling tool. In examples, downhole tool 100 may also include a fluid analysis module 118, which may be operable to process information regarding a fluid sample, as described below. Downhole tool 100 may be used to collect fluid samples from subterranean formation 106 and may obtain and separately store different fluid samples from subterranean formation 106.

In examples, fluid analysis module 118 may comprise at least one sensor that may continuously monitor a fluid such as a reservoir fluid, formation fluid, wellbore fluid, or nonnative formation fluid (e.g., drilling fluid filtrate). Such monitoring may take place in a fluid flow line or a formation tester probe, such as in a pad or packer. Alternatively, continuous monitoring of fluid may include making measurements to investigating the formation, for example, by measuring a local formation property with a sensor. Sensors may measure a contrast between drilling fluid filtrate properties and formation fluid properties. Fluid analysis module 118 may be operable to derive properties and characterize the fluid sample. By way of example, fluid analysis module 118 may measure absorption, transmittance, or reflectance spectra, and translate these measurements into, for example, component concentrations of the fluid sample, which may be lumped component concentrations, as described above. The fluid analysis module 118 may also measure gas-to-oil ratio, fluid composition, water cut, live fluid density, live fluid viscosity, formation pressure, formation temperature and/or fluid composition. Fluid analysis module 118 may also be operable to determine fluid contamination of the fluid sample and may include any instrumentality or aggregate of instrumentalities operable to compute, classify, process, transmit, receive, retrieve, originate, switch, store, display, manifest, detect, record, reproduce, handle, invert, or utilize any form of information, intelligence, or data for business, scientific, control, or other purposes. The absorption, transmittance, or reflectance spectra absorption, transmittance, or reflectance spectra may be measured with sensors 116 by way of standard operations. For example, fluid analysis module 118 may include random access memory (RAM), one or more processing units, such as a central processing unit (CPU), or hardware or software control logic, ROM, and/or other types of nonvolatile memory. Fluid analysis module 118 and downhole tool 100 may be communicatively coupled via communication link 120 with information handling system 122.

Any suitable technique may be used for transmitting signals from the downhole tool 100 to the surface 112. As illustrated, a communication link 120 (which may be wired or wireless, for example) may be provided that may transmit data from downhole tool 100 to an information handling system 122 at surface 112. Information handling system 122 may include a processing unit 124, a monitor 126, an input device 128 (e.g., keyboard, mouse, etc.), and/or computer media 130 (e.g., optical disks, magnetic disks) that can store code representative of the methods described herein. Information handling system 122 may act as a data acquisition system and possibly a data processing system that analyzes information from downhole tool 100. For example, information handling system 122 may process the information from downhole tool 100 for determination of fluid contamination. The information handling system 122 may also determine additional properties of the fluid sample (or reservoir fluid), such as component concentrations, pressure-volume-temperature properties (e.g., bubble point, phase envelop prediction, etc.) based on the fluid characterization. This processing may occur at surface 112 in real-time. Alternatively, processing may occur downhole hole or at surface 112 or another location after recovery of downhole tool 100 from wellbore 104. Alternatively, the processing may be performed by an information handling system in wellbore 104, such as fluid analysis module 118. The resultant fluid contamination and fluid properties may then be transmitted to surface 112, for example, in real-time. As described herein, "real-time" may be generally understood to relate to a system, apparatus, or method in which a set of input data is processed and available for use within 100 milliseconds ("ms"). In further examples, the input data may be processed and available for use within 90 ms, within 80 ms, within 70 ms, within 60 ms, within 50 ms, within 40 ms, within 30 ms, within 20 ms, or any ranges therebetween. In some examples, real-time may relate to a human's sense of time rather than a machine's sense of time. For example, processing which results in a virtually immediate output, as perceived by a human, may be considered real-time processing. It is also noted that while FIG. 1 shows one example configuration of a drilling operation, the concepts disclosed herein may be used and adapted to any suitable configuration, such as to the configuration of FIG. 2 which shows downhole tool 100 used in a drill string during a drilling operation.

Figure 2:
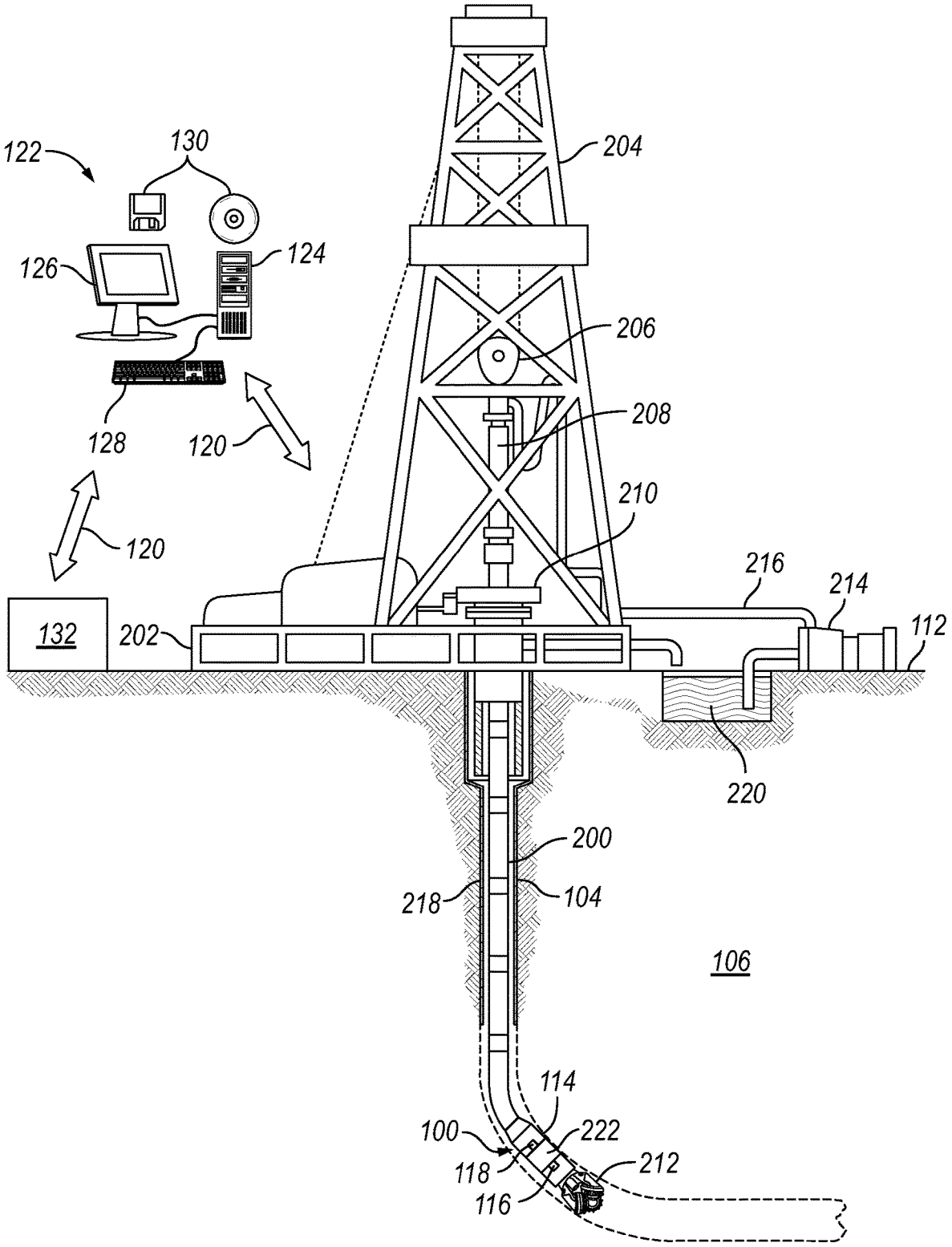
FIG. 2 illustrates a schematic view of another well in which an example embodiment of a fluid sample system is deployed.

Referring now to FIG. 2, a schematic diagram of downhole tool 100 disposed on a drill string 200 in a drilling operation. Downhole tool 100 may be used to obtain a fluid sample, for example, a fluid sample of a reservoir fluid from subterranean formation 106. The reservoir fluid may be contaminated with well fluid (e.g., drilling fluid) from wellbore 104. As described herein, the fluid sample may be analyzed to determine fluid contamination and other fluid properties of the reservoir fluid. As illustrated, a wellbore 104 may extend through subterranean formation 106.

As illustrated, drilling platform 202 may support a derrick 204 having a traveling block 206 for raising and lowering drill string 200. Drill string 200 may include, but is not limited to, drill pipe and coiled tubing, as generally known to those skilled in the art. A kelly 208 may support drill string 200 as it may be lowered through a rotary table 210. A drill bit 212 may be attached to the distal end of drill string 200 and may be driven either by a downhole motor and/or via rotation of drill string 200 from the surface 112. Without limitation, drill bit 212 may include roller cone bits, PDC bits, natural diamond bits, any hole openers, reamers, coring bits, and the like. As drill bit 212 rotates, it may create and extend wellbore 104 that penetrates various subterranean formations 106. Pump 214 may circulate drilling fluid through a feed pipe 216 to kelly 208, downhole through interior of drill string 200, through orifices in drill bit 212, back to surface 112 via annulus 218 surrounding drill string 200, and into a retention pit 220.

Drill bit 212 may be just one piece of a downhole assembly that may include one or more drill collars 222 and downhole tool 100. Downhole tool 100, which may be built into the drill collars 222 may gather measurements and fluid samples as described herein. One or more of the drill collars 222 may form a tool body 114, which may be elongated as shown on FIG. 2. Downhole tool 100 may be similar in configuration and operation to downhole tool 100 shown on FIG. 1 except that FIG. 2 shows downhole tool 100 disposed on drill string 200. Alternatively, the sampling tool may be lowered into the wellbore after drilling operations on a wireline. It is noted that while the language used to describe downhole tool 100 throughout this disclosure frequently refers to sampling of fluids, that downhole tool 100 (e.g., referring to FIGS. 1 and 2) may comprise any downhole tool which is disposed in a drill string, wellbore, borehole, tool string, or else disposed on a wireline.

Downhole tool 100 may further include one or more sensors 116 for measuring properties of the fluid sample reservoir fluid, wellbore 104, subterranean formation 106, or the like. The one or more sensors 116 may be disposed within fluid analysis module 118. In examples, more than one fluid analysis module may be disposed on drill string 200. The properties of the fluid are measured as the fluid passes from the formation through the tool and into either the wellbore or a sample container. As fluid is flushed in the near wellbore region by the mechanical pump, the fluid that passes through the tool generally reduces in drilling fluid filtrate content, and generally increases in formation fluid content. The downhole tool 100 may be used to collect a fluid sample from subterranean formation 106 when the filtrate content has been determined to be sufficiently low. Sufficiently low depends on the purpose of sampling. For some laboratory testing, below 10% drilling fluid contamination is sufficiently low, and for other testing, below 1% drilling fluid filtrate contamination is sufficiently low. Sufficiently low also depends on the nature of the formation fluid such that lower requirements are generally needed, for example, for formation fluids having lighter oils as designated by a higher gas-to-oil (GOR) ratio or a higher American Petroleum Institute (API) gravity. Sufficiently low also depends on the rate of cleanup in a cost benefit analysis since longer pumpout times required to incrementally reduce the contamination levels may have prohibitively large costs. As previously described, the fluid sample may comprise a reservoir fluid, which may be contaminated with a drilling fluid, drilling fluid filtrate, another contaminant, or a combination thereof. Downhole tool 100 may obtain and separately store different fluid samples from subterranean formation 106 with fluid analysis module 118. Fluid analysis module 118 may operate and function in the same manner as described above. However, storing of the fluid samples in the downhole tool 100 may be based on the determination of the fluid contamination. For example, if the fluid contamination exceeds a tolerance, then the fluid sample may not be stored. If the fluid contamination is within a tolerance, then the fluid sample may be stored in the downhole tool 100. In examples, contamination may be defined within fluid analysis module 118.

Figure 3:
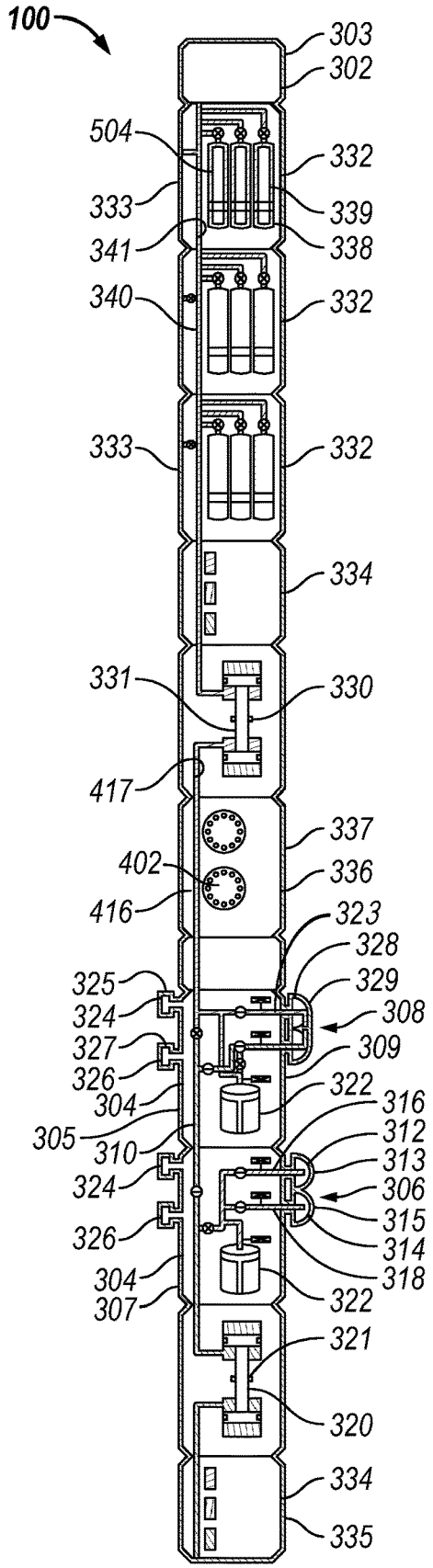
FIG. 3 illustrates a schematic of a downhole tool.

FIG. 3 illustrates a schematic of downhole tool 100. As illustrated, downhole tool 100 may include a power telemetry section 302 through which downhole tool 100 may communicate with other actuators and sensors in a conveyance (e.g., conveyance 102 on FIG. 1 or drill string 200 on FIG. 2), and/or the conveyance's communications system, such as information handling system 122 (e.g., referring to FIG. 1). In examples, power telemetry section 302 may also be a port through which the various actuators (e.g., valves) and sensors (e.g., temperature and pressure sensors) in downhole tool 100 may be controlled and monitored. In one or more examples, control and monitoring may be performed by an information handling system 122.

As mentioned, information from downhole tool 100 may be gathered and/or processed by information handling system 122 (e.g., referring to FIGS. 1 and 2). The processing may be performed real-time during data acquisition or after recovery of downhole tool 100. Processing may alternatively occur downhole or may occur both downhole and at surface 112. In some examples, signals recorded by downhole tool 100 may be conducted to information handling system by way of conveyance. Information handling system may process the signals, and the information contained therein may be displayed for an operator to observe and stored for future processing and reference. Information handling system may also contain an apparatus for supplying control signals and power to downhole tool 100.

In examples, downhole tool 100 may include one or more enhanced probe sections 304 and stabilizers 324. Each enhanced probe section may include a dual probe section 306 or a sampling probe section 308. Both of which may extract fluid from the reservoir and deliver said fluid to a flow line 310 that extends from one end of downhole tool 100 to the other. Without limitation, dual probe section 306 includes two probes 312, 314 which may extend from downhole tool 100 and press against the inner wall of wellbore 104 (e.g., referring to FIG. 1). Probe flow lines 316 and 318 may connect probe 312, 314 to flow line 310 and allow for continuous fluid flow from the formation 106 to flow line 310. A high-volume bidirectional pump 320 may be used to pump fluids from the formation, through probe flow lines 316, 318 and to flow line 310. Alternatively, a low volume pump bidirectional piston 322 may be used to remove reservoir fluid from the reservoir and house them for asphaltene measurements, discussed below. Two standoffs or stabilizers 324, 326 hold downhole tool 100 in place as probes 312, 314 press against the wall of wellbore 104. In examples, probes 312, 314 and stabilizers 324, 326 may be retracted when downhole tool 100 may be in motion and probes 312, 314 and stabilizers 324, 326 may be extended to sample the formation fluids at any suitable location in wellbore 104. As illustrated, probes 312, 314 may be replaced, or used in conjunction with, sampling probe section 308. Sampling probe section 308 may operate and function as discussed above for probes 312, 314 but with a single probe 328. Other probe examples may include, but are not limited to, oval probes, packers, or circumferential probes.

In examples, flow line 310 may connect other parts and sections of downhole tool 100 to each other. For example, Additionally, downhole tool 100 may include a second high-volume bidirectional pump 330 for pumping fluid through flow line 310 to one or more multi-chamber sections 332, one or more amide side fluid density modules 334, and/or one or more dynamic subsurface optical measurement tools 336.

Figure 4:
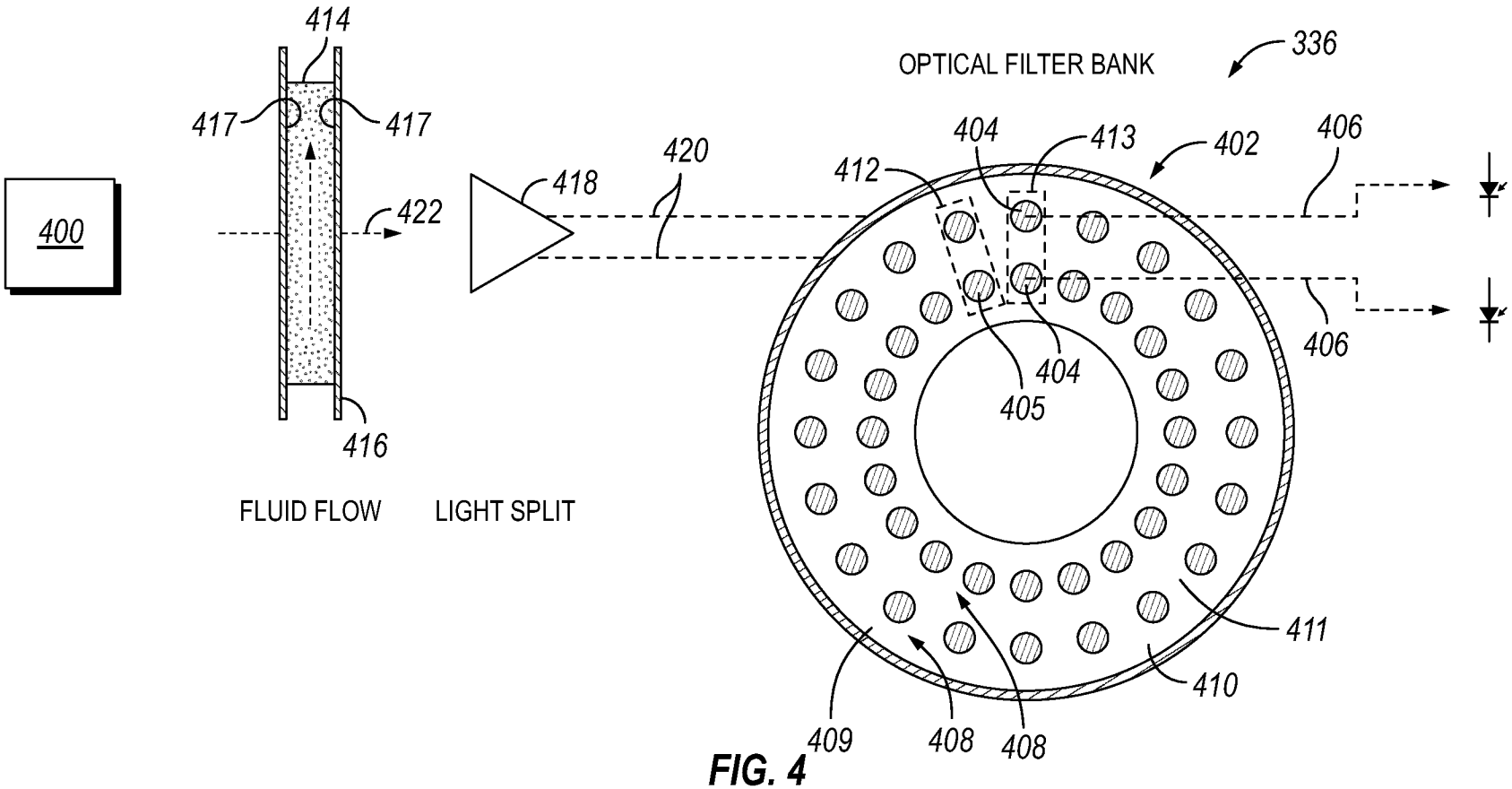
FIG. 4 illustrates a hardware configuration of a dynamic subsurface optical measurement tool.

FIG. 4 depicts a hardware configuration of a dynamic subsurface of optical measurement tool 336. It should be noted that channel 406, disclosed herein, may be a measurement of the light transmittance through an optical filter 402. Optical measurement tool 336 may include a light source 400, a filter bank 402 comprising a plurality of optical filters 404 (measurement of the light transmittance through an optical filter is called a channel 406) configured as two rings 408 on optical plate 410, within a channel pair 412 on each azimuth. It should be noted that each channel 406 may be designed, based on the construction of each channel-respective optical filter 406, to measure different properties of fluid 414. During the rotation of optical plate 410, the two optical filters 404 on a channel pair 412 may be synchronized spatially or in time to measure substantially the same fluid 414 in viewing window 416. Viewing window 416 may be disposed within or be a part of flow line 310 (e.g., referring to FIG. 1). As discussed below, and illustrated in FIG. 4, an active channel pair 413 is a channel pair 412 in which optical measurements are being taken to form one or more channels 406. In some examples, channel pairs 412 may be near synchronized such that channel pairs 412 have a sufficient probability of observing the same phase, i.e., better than 10%, but more desirably, more than 50%, and yet more desirably, more than 80%. In other examples, more than two channels 406 may be sufficiently synchronized according to a desired probability of observing a single phase in time or space. A velocity calculation of the fluid phase specific velocities may be used to aid synchronization over longer distances, or time. Alternatively, distribution calculations, or autocorrelation calculations may be used to improve the synchronization over longer distances or time. If the channels are sufficiently close in distance or time, the channel signals may not need additional efforts of synchronization. During measurement, fluid samples 414 (which is formation fluid from passageway 306) may flow through a viewing region as a non-limiting example constructed by a set of windows or other transparent/semi-transparent region of the flow path. Alternatively, the viewing region or viewing area might not be transparent to visible light but rather to the form of energy used to measure the fluid characteristics for a given sensor. As such a viewing region or area for an acoustic sensor would ideally have a low acoustic impedance even if it is not transparent to visible light. Alternatively, the viewing region or area may be transparent (i.e., pass energy with low attenuation) to infrared light, or magnetic fields instead of visible light. In some examples for some sensors, the viewing region 408 or area is more generally a measurement region 408 or area as is the case with some phase behavior sensors or some density sensors. In examples, viewing region 408 may be at least a part of passageway 306 and/or a branch off of passageway 306). In one nonlimiting example, light 418 absorbed by fluid sample 414 may be split into at least two ray paths 420. Split light rays 420 may be measured by detectors, not shown, as they pass through channel pair 412 separately. Filter bank 402 may rotate to another channel pair 412 after the measurement of each channel 406 from channel pair 412 and may dynamically gather an optical spectra measurement of all channels after a full sampling channel rotation. It should be noted, the methods disclosed herein may not be limited in simultaneous measurements of a channel pair 412 but may also apply to cases with one or more filter banks 402, at least one channel 406, or, alternatively, two or more channels 406. Mixed sensor types may also be utilized such as but not limited to a density channel with an optical channel.

Generally, in conventional interpretations of optical analysis, fluid sample 414 may keep a consistent or same fluid phase during each of a ten-second measurement circle. Fluid sample 414 may comprise a mixture of hydrocarbons and water, gas, or solids, especially in the case of water-based-mud), and also in transition zone sampling or sampling below the saturation pressure of a liquid for which gas evolves. Generally, fluid sample 414 may flow through flow path 422 of light 418 and into an active channel pair 413 instead of or may rest for a static measurement. Moreover, channels 406 within a given rotation may measure multiple phases. For example, some channels 406 of one or more channel pairs 412 in a rotation may measure hydrocarbon, while other channels 406 may measure the water in the same measurement rotation. Consequently, for large portions of downhole formation pump outs, it may be rare to find an entire rotation or set of channel measurements from one or more sensors that make a measurement for a single phase. In such instances, the conventional fluid analysis that uses a combination of channels from one or more samples to extract sample properties (chemical or physical) or a phase signature extraction may fail due to the multi-phase flow.

As disclosed herein, multi-channel selectivity (specificity for a given phase) may be greater than single channel sensitivity. Each phase signal may be an optical signal or a non-optical signal. In some examples, each channel 406 may be sensitive to a fluid phase, wherein each channel 406 may have a different response to a fluid phase by comparison to a non-fluid phase. Conversely, some channels 406 may not have high selectivity, but correlating with at least one additional channel 406 may increase selectivity of one or both the channels.

During fluid sampling operation, downhole tool 100 (e.g., referring to FIG. 1) is exposed to and interacts with wellbore fluids and/or reservoir fluids. Both wellbore fluids and/or reservoir fluids may pose a problem by sticking to downhole tool 100 sticking and fluid samples 414 (e.g., referring to FIG. 4), that may at least partially comprise wellbore fluids and/or reservoir fluids, sticking to flow lines 310, 316, and/or 318 as well as sticking to and clogging pumps and/or measurement sensors. Additionally, when disposing downhole tool 100 into wellbore 104 that may further comprise sand, sticking of the sand and fluid may occur along conveyance 102.

Figure 5A:
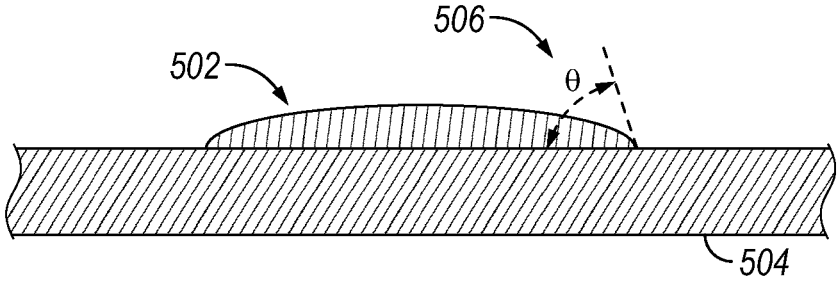
FIG. 5A illustrates a contact angle between a surface and a fluid.
Figure 5B:
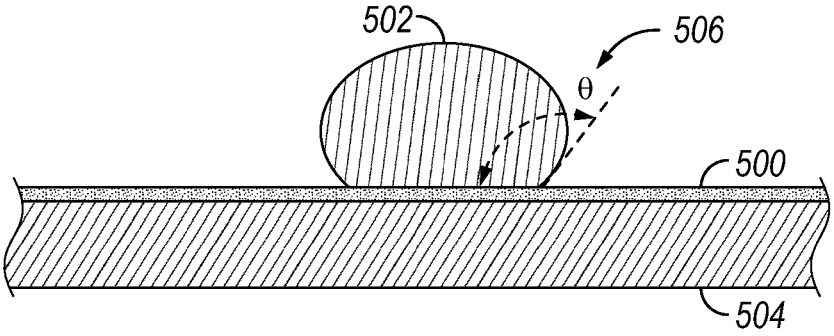
FIG. 5B illustrates the contact angle between a wettability modifier coating and the fluid.

FIGS. 5A and 5B illustrate methods and systems that may be utilized to repel unwanted fluids at a molecular level utilizing a wettability modifier coating 500. A wettability modifier coating 500 may comprise an oleophobic coating, hydrophobic coating, or a combination thereof. An oleophobic coating should repel oils, and a hydrophobic coating should repel water. As illustrated in FIGS. 5A, a fluid 502 which may comprise wellbore fluids and/or reservoir fluids may come into contact with a surface 504. Surface 504 may be an exterior or internal surface of downhole tool 100 (e.g., referring to FIGS. 1 and 2), as well as any internal or external surface of any of the downhole tools described herein.

Additionally, surface 504 may comprise an internal surface of flow lines 310, 316, 318 (e.g., referring to FIG. 3) and/or a surface of viewing window 416 (e.g., referring to FIG. 4). While viewing window 416 may comprise glass, it should be understood that viewing window 416 may comprise any suitable transparent material through which a fluid is conveyed and through which light may pass. Additionally, or alternatively, surface 504 may comprise an internal surface 339 of a sample container 338 (e.g., referring to FIG. 3) disposed in multi-chamber 332. Additionally, or alternatively, surface 504 may comprise an external surface 103 or 1010 of conveyance 102 (e.g., referring to FIG. 10B), an external surface 303 of power telemetry section 302 (e.g., referring to FIG. 3), and/or an external surface 333 of multi-chamber sections 332 (e.g., referring to FIG. 3). Additionally, or alternatively, surface 504 may comprise an external surface 335 of fluid density module 334 (e.g., referring to FIG. 3), an internal surface 331 of bidirectional pump 330 (e.g., referring to FIG. 3), and/or an external surface 337 of optical measurement tool 336 (e.g., referring to FIG. 3). Additionally, or alternatively, surface 504 may comprise any surface interposed between a light source and an optical sensor operably coupled to downhole tool 100. For example, a surface interposed between light source 400 and an optical sensor may be any surface 417 through which flow path 422 (e.g., referring to FIG. 4) of light 418 passes. Additionally, or alternatively, surface 504 may comprise a surface 411 of optical plate 410, an internal surface (not shown) or external surface 313, 315, and/or 329 of probes 312, 314, and/or 328 (e.g., referring to FIG. 3). Additionally, or alternatively, surface 504 may comprise an external surface 309 of sampling probe section 308 (e.g., referring to FIG. 3), an internal surface (not shown) of low-volume bidirectional piston 322 (e.g., referring to FIG. 3), an external surface 307 of dual probe section 306 (e.g., referring to FIG. 3), an internal surface 321 of hi-volume bidirectional pump 320 (e.g., referring to FIG. 3), and/or an external surface 325 and 327. Additionally, or alternatively, surface 504 may comprise any of stabilizers 324 and 326 (e.g., referring to FIG. 3), an external surface 305 of enhanced probe section 304 (e.g., referring to FIG. 3), a surface 405 of optical filters 404, a surface (not shown) of channel 406 (e.g., referring to FIG. 4), and/or a surface 409 of viewing region 408. Additionally, or alternatively, surface 504 may comprise an internal surface 307 of passageway 306 (e.g., referring to FIG. 3), a surface (not shown) of a detector (not shown), a surface (not shown) of a filter bank 402 (e.g., referring to FIG. 4), and/or an internal surface 341 of fluid conduit 340 (e.g., referring to FIG. 3). Additionally, or alternatively, surface 504 may comprise any surface disposed within downhole tool 100 in fluid communication with fluid sample 414, a formation fluid, and/or a wellbore fluid.

As discussed in the foregoing, downhole tool 100 may comprise a fluid sampling tool. Downhole tool 100 may alternatively comprise any of natural gamma ray tools, logging tools, logging while drilling tools (LWD), resistivity tools, sonic and ultrasonic tools, nuclear magnetic resonance tools, borehole seismic tools, cased hole electric line tools, cement bond tools, casing collar locators, gamma perforating tools, wireline pressure setting assemblies, casing expander tools, milling tools, cutting tools, tractors, bottom hole assemblies (BHAs), other wireline tools, pipe inspection tools, anchoring tools, plug pulling tools, debris removal tools and other cleaning tools, imaging tools, look-ahead and look-around tools, rotary coring tools, seismic tools, production logging tools, pulsed neutron tools, and any combinations thereof. As discussed in the foregoing, when a wettability modifier coating 500 is applied to a surface 504, the wettability modifier coating 500 may be operable to repel unwanted fluids from the surface 504. In such instances, it may be expected that a contact angle should form between an unwanted fluid and the surface. Depending on the composition of the unwanted fluid, the magnitude of a contact angle formed may vary from composition to composition. FIGS. 5A and 5B illustrate how a contact angle may vary depending on the presence of one or more wettability modifier coatings 500.

As illustrated in FIG. 5A, contact angle 506 of the surface 504 without a wettability modifier coating 500 may be less than 90 degrees (e.g., with respect to water). In FIG. 5B, a wettability modifier coating 500 may be applied to surface 504 to modify the wettability of the surface 504. For example, the application of the wettability modifier coating 500 to surface 504 may increase contact angle 506 to over 90 degrees (e.g., with respect to water). This may indicate wettability modification. Other ways to ascertain whether or not wettability modifier coating 500 has been sufficiently applied may include measuring a friction coefficient of the surface to which the wettability modifier coating 500 has been applied. An observable reduction in a friction coefficient would be expected for a surface having the wettability modifier coating 500 applied thereto. Alternatively, presence of wettability modifier coating 500 may be determined with a sessile drop technique. The use of oleophobic coatings and/or hydrophobic coatings may allow for an increase in the velocity flow of fluid samples 414 within flow lines 310, 316, and/or 318 (referring to FIG. 3), may allow for faster cleaning of downhole tool 100, and/or may allow sensors or a sensing region within downhole tool 100 to remain clean. In turn, a cleaner sensing region or sensor may be therefore better suited to making accurate measurements, having a travel path between sensor receptors and a fluid or measurement region of interest unimpeded by contaminants.

Wettability modifier coating 500 may comprise a hydrophobic coating or have hydrophobic properties. Where used, a hydrophobic coating should modify the wettability of the surface 504 to make surface 504 more hydrophobic. For example, a contact angle 506 of surface 504 with a hydrophobic coating applied thereto with respect to water may be over 90 degrees, for example, 90 degrees to 150 degrees. Alternatively, 90 degrees to 130 degrees, 100 degrees to 150 degrees, 100 degrees to 130 degrees, 110 degrees to 150 degrees, 110 degrees to 130 degrees, about 115 degrees, or any ranges therebetween. As used herein, contact angle for a hydrophobic coating is measured with deionized water using a goniometer at standard temperature and pressure. A hydrophobic coating may be made from any of a variety of hydrophobic materials. Examples of suitable materials for wettability modifier coating 500 include silicones, siloxanes, silane, fluorosilane, and/or organosilicones, which may include for example, an organosiloxane, an organosilane, a fluoro-organosiloxane, and/or a fluoro-organosilane. Wettability modifier coating 500 may comprise a polysiloxane or an organo-modified polysiloxane, which may include a di-betaine polysiloxane or a di-quaternary polysiloxane. Wettability modifier coating 500 may comprise a fluoroalkyl-group, perfluoropolyether, or the like. In another example, wettability modifier coating 500 may comprise a fluoro-organosiloxane or a fluoro-organosilane compound, which may include, for example, 2-(n-perfluoro-octyl)-ethyltriethoxysilane and perfluoro-octyldimethyl chlorosilane. In some examples, wettability modifier coating 500 may comprise a polyamide, such as a silyl-modified polyamide. In some examples, wettability modifier coating 500 may comprise a nano composite of a metal oxide polystyrene (e.g., a nano composite of manganese oxide polystyrene or zinc oxide polystyrene), hydrophobic nano- or micro-materials, a paraffin, a chlorinated paraffin, fluorocarbons, FR plasma-formed superhydrophobic materials, a TFE telomer, a perfluoroalkyl compound, a perfluoropolyether, an alkylketene dimer, silica, titania, calcium carbonate, polyvinyl chloride, an epoxy, a wax, an adhesive, a resin, an elastomer, a sealant, hydrophobic paint, a hydrophobic polymer, hydrophobic nanoparticles, the like, and/or combinations thereof. In some examples, wettability modifier coating 500 may comprise a material exhibiting superhydrophobicity. In some examples, wettability modifier coating 500 may comprise a surfactant, such as a hydrophobic surfactant, an ethoxylated surfactant, or a surfactant having hydrophilic and hydrophobic groups. Surfactants may include, for example, alkylphenol ethoxylates such as nonylphenol ethoxylates, octylphenol ethoxylates, and dodecylphenol ethoxylates. In some examples, the hydrophobic coating may comprise propylene glycol propyl ether, 1-propoxy-2-propanol, ethyl nonafluoroisobutyl ether, ethyl nonafluorobutyl ether, or a combination thereof.

Prior to application to a surface 504, one or more of the chemical species listed throughout this disclosure may be individually or collectively present in an application fluid comprising wettability modifier coating 500 in an amount between 0.01 wt. % to about 99.9 wt. %. Alternatively, from about 0.01 wt. % to about 5 wt. %, about 5 wt. % to about 10 wt. %, about 10 wt. % to about 15 wt. %, about 15 wt. % to about 25 wt. %, about 25 wt. % to about 35 wt. %, about 35 wt. % to about 45 wt. %, about 45 wt. % to about 55 wt. %, about 55 wt. % to about 65 wt. %, about 65 wt. % to about 75 wt. %, about 75 wt. % to about 85 wt. %, about 85 wt. % to about 95 wt. %, about 95 wt. % to about 99.9 wt. %, or any ranges therebetween. These one or more chemical species may likewise be present in these above-listed concentrations in a wettability modifier coating 500 adhered to a downhole tool or tool string.

As mentioned previously, wettability modifier coating 500 may be characterized as having a contact angle 506 within certain ranges when exposed to droplets of, for example, deionized water or oil (e.g., hexadecane). Contact angle 506 may, in certain instances, conform to the following mathematical expression.

$$\gamma_{SG}=\gamma_{SL}+\gamma_{LG}\cos(\theta)$$

where $\gamma_{SG}$ is an interfacial tension between a solid and gas, $\gamma_{SL}$ is an interfacial tension between a solid and liquid, $\gamma_{LG}$ is an interfacial tension between a liquid and gas, and θ is a contact angle 506 measured by a goniometer at standard pressure and temperature.

Wettability modifier coating 500 may comprise an oleophobic coating. Where used, a hydrophobic coating 500 should modify the wettability of the surface 504 to make surface 504 more oleophobic. For example, a contact angle 506 of surface 504 with respect to oil may range from 60 degrees to 90 degrees, for example, 60 degrees to 80 degrees, 75 degrees to 100 degrees, 80 degrees to 90 degrees, about 85 degrees, or any ranges therebetween. As referred to herein, contact angles 504 for oleophobic coatings are measured with n-hexadecane using a goniometer at standard temperature and pressure. Wettability modifier coating 500 may be made from any of a variety of oleophobic materials. Examples of oleophobic materials may comprise fluoropolymers, which may include, for example, polytetrafluoroethylene. Other examples may include, for example, perfluoropolyether, silane, an oleophobic perfluoroalkyl substances (PFAS), non-polar polymers, fluorinated polymers, fluoroalkyl-silica, ceramics, fluorinated phosphonates, polymeric organometallic films, perfluoroalkene ethers, self-assembled monolayer of phosphonates (SAMPS), phosphonic acids, monomeric or oligomeric amphiphilic perfluorinated hydrocarbons, $SiO_2$ nanoparticles, polydiallyldimethylammonium chloride (PDDA) complexed with a fluorosurfactant, the like, and/or combinations thereof.

A wettability modifier coating 500 may be applied to surface 504 using any suitable technique, including dip coating, spray coating, particle deposition, vapor deposition, physical vapor deposition (PVD), chemical vapor deposition (CVD), atomic layer deposition (ALD), sputtering, line-of-sight deposition, casting, immersion in a gel (e.g., sol-gel), or the like. Alternatively, wettability modifier coating 500 may be applied to surface 504 with a wipe. Wipe (not shown) may be partially or fully saturated with a wettability modifier or application fluid such that, upon wiping of surface 504 with a wipe, wettability modifier coating 500 may be left as a residue and allowed to cure or dry. Yet alternatively, wettability modifier coating 500 may be applied to surface 504 in a laboratory environment, or outside in an external environment. For example, a tool having a surface 504 may be cleaned and/or dried in a clean room or clean tent, or in an open field environment before application of wettability modifier coating 500 to surface 504. Additionally, or alternatively, wettability modifier coating 500 may be pumped through a tool in a flowline as an application fluid, or surface 504 may be wiped or sprayed with an application fluid comprising wettability modifier coating 500, such as a by wiping or spraying a sapphire surface or a probe face.

Wettability modifier coating 500 may have any suitable thickness. For example, wettability modifier coating 500 may have an average thickness in a range of, without limitation, about 1 nanometer to about 0.01 millimeters. Alternatively, from about 1 nanometer to about 2 nanometers, about 2 nanometers to about 4 nanometers, about 4 nanometers to about 10 nanometers, about 10 nanometers to about 100 nanometers, about 100 nanometers to about 1,000 nanometers, about 1,000 nanometers to about 0.01 millimeters, or any ranges therebetween. Wettability modifier coating 500 may be characterized as having uniform thickness, approximately uniform thickness, or as having an uneven thickness distribution. The average thickness of wettability modifier coating 500 may impact the effectiveness of wettability modifier coating 500 to repel unwanted fluids.

Additionally, wettability modifier coating 500 may be characterized by a high temperature resistance, may exhibit minimal or no resistance to heat transfer, may be compatible with organic solvents, neutral or acidic solvents, petroleum, and/or acetone, may exhibit high chemical resistance, and may have long-lasting durability, even upon exposure to highly turbulent flow. These attributes may be particularly advantageous when wettability modifier coating 500 is applied to a sensing region of downhole tool 100, such as when downhole tool 100 comprises an optical measurement tool.

Figure 6:
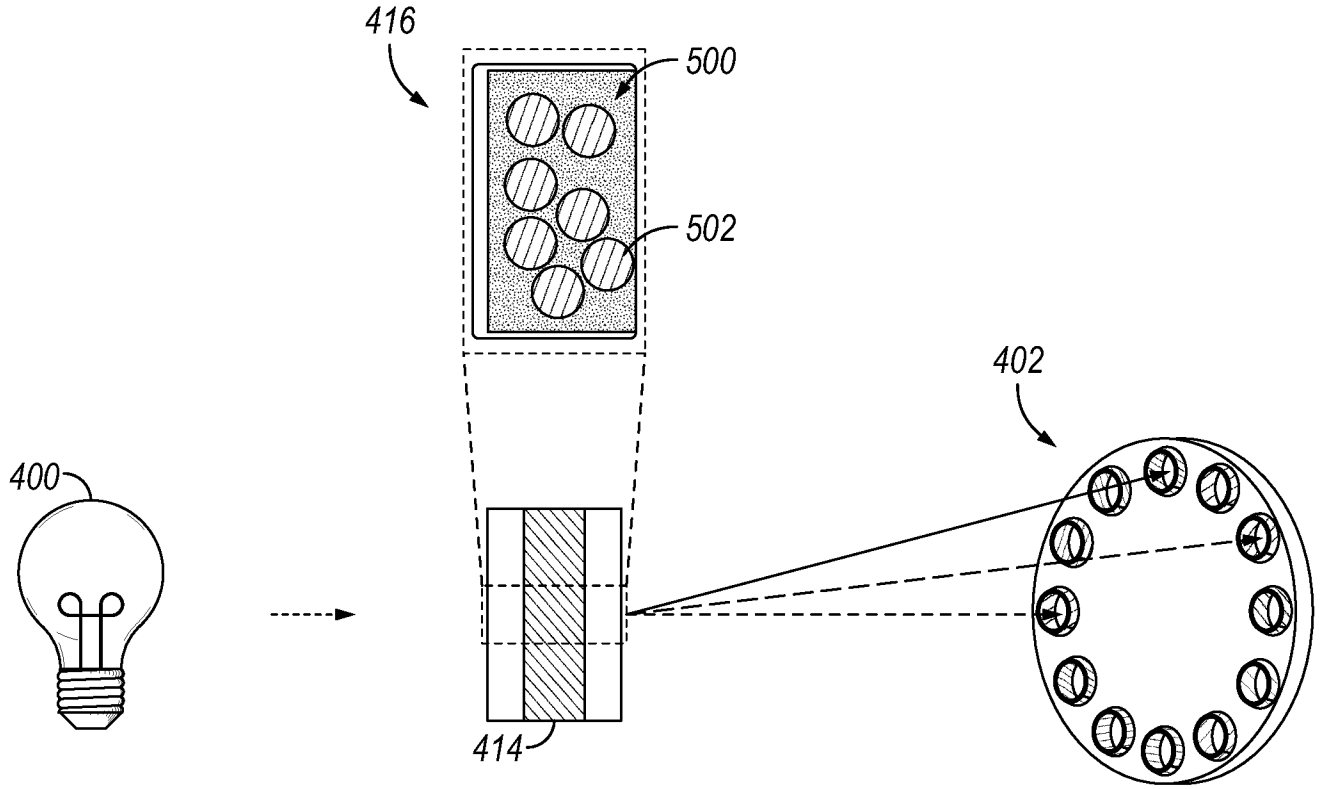
FIG. 6 illustrates the sampling operations utilizing a downhole tool to analyze a fluid sample utilizing the optical measurement tool.

FIG. 6 illustrates sampling operations utilizing downhole tool 100 to analyze fluid sample 414 utilizing optical measurement tool 336 described above in FIG. 4. By utilizing an optical filter 402 and a light source 400, composition and contamination of fluid sample 414 may be detected within viewing window 416. However, fluid sample 414 may diminish a light intensity of optical measurement tool 336 as particulates in fluid sample 414 may stick to viewing window 416 from which light from light source 400 passes through. In this example, wettability modifier coating 500 may be applied as a coating on an internal surface of viewing window 416. This may act as a barrier between fluid sample 414 and viewing window 416 and may prevent particulates from fluid sample 414 from sticking to and/or smearing viewing window 416 and diminishing an amount of light projected within optical measurement tool 336.

Figure 7:
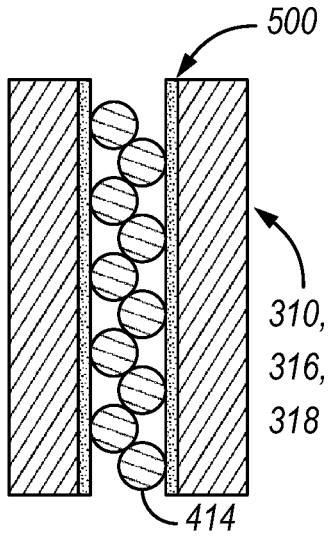
FIG. 7 illustrates flow lines within a downhole tool.

FIG. 7 illustrates flow lines 310, 316, and/or 318 within downhole tool 100, that may be utilized for movement of fluid, such as fluid samples 414 through downhole tool 100. Generally, as fluid sample 414 traverses through flow lines 310, 316, and/or 318, there may exist friction between fluid sample 414 and flow lines 310, 316, and/or 318 of downhole tool 100. A specific frictional value may depend on viscosity of fluid sample 414. As a result of this friction, fluids may be less efficient to process through pumps and take longer to pump out. In FIG. 7, wettability modifier coating 500 may be applied to an internal surface of flow lines 310, 316, and/or 318. This may reduce friction between fluid sample 414 and flow lines 310, 316, and/or 318 as fluids sample 414 passes through flow lines 310, 316, and/or 318. Additionally, this may increase fluid velocity which may also decrease time for cleaning downhole tool 100.

Figure 8A:
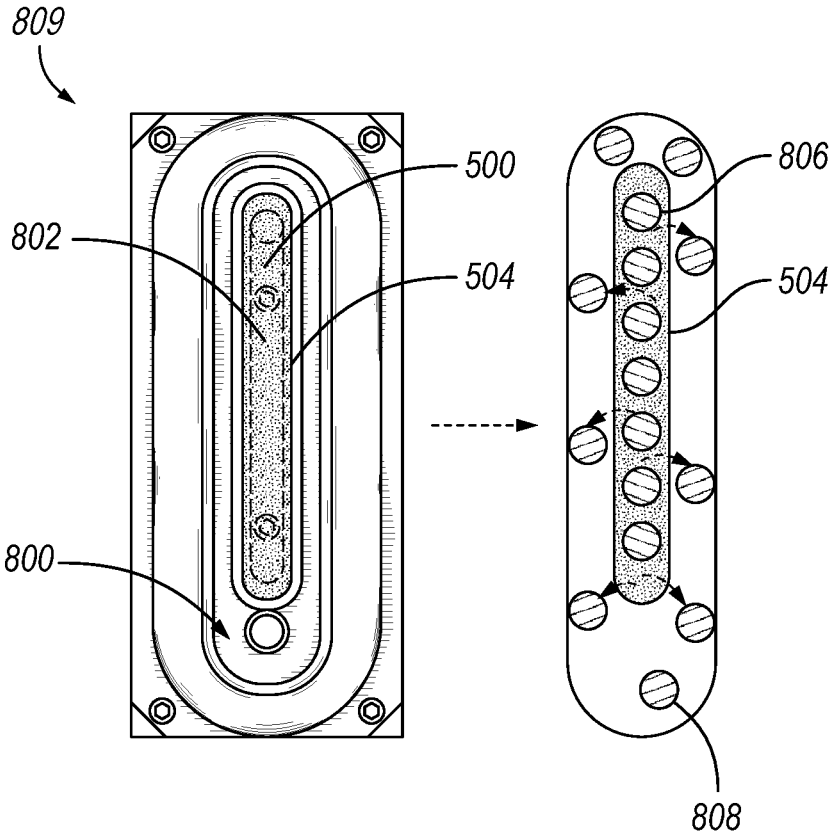
FIG. 8A illustrates an application of a wettability modifier coating to a focus sampling probe section.

FIG. 8A illustrates an application of wettability modifier coating 500 on a sampling probe section 308. Sampling probe section 308 may comprise a focused sampling probe 809. Focused sampling probe 809 is a dual flow probe with a guard surface that captures contaminants and a sample (inner) surface that captures clean fluid. As illustrated in FIGS. 8A, sampling probe section 308 may comprise a focus sampling probe 809, which may operate and function as described below. In examples, focus sampling probe 809 comprises a guard side 800 and a sample side 802. Guard side 800 is operable to protect sample side 802 from external forces, such as from collisions or interactions with a side of a drill string or casing while conveying downhole tool 100 downhole to a target sampling location.

FIG. 8A shows focused sampling probe 809 having an aperture 810. Aperture 810 is a cup-like structure that is molded to sealing pad 812 to facilitate sealing. Other geometries are possible, but the basic principle is to support sealing pad 812 such that it seals against the borehole or wellbore without drawing in free fluid from a flow area. In some embodiments, sealing pad 812 may be retractable. Aperture 810 may be operable to seal sealing pad 812 to a borehole wall. Aperture 810 may comprise metal, such as steel. Focused sampling probe 809 may be further equipped with a screen assembly (not show) which, upon retracting of sealing pad 812, may allow for a wiper cylinder to push mudcake or sand from a screen area of sample side 802. In alternative embodiments, sample side 802 may comprise a gravel pack type of material instead of a screen to screen for very fine particles into one or more flowlines 316 and 318, or into one or more flowlines fluidically connected to flow line 310. One skilled in the art should understand that in either of the above-described aspects of the invention the probe assembly has a large exposure volume sufficient for testing and sampling large, elongated sections of the formation. In operation, pressure at sample side 802 may be reduced, thereby drawing in formation fluids from a surface of a borehole wall to which sealing pad 812 is sealed. In this manner, fluid samples may be collected and transported via flow lines 316 and 318.

In one or more examples, wettability modifier coating 500 may be applied to sample side 802, which acts as a repellent and repels contaminants. Wettability modifier coating 500 may be chosen to repel unwanted oil/water-based filtrate compounds 808 that may be disposed in oil-based fluids or water-based fluids 806 present in an environment surrounding downhole tool 100. Thus, during sampling operations unwanted oil/water-based filtrate compounds 808 are repelled from focus sampling probe 809 by wettability modifier coating 500. This may also drastically decrease the amount of time needed to clean up to a low or untraceable contamination level.

Figure 8B:
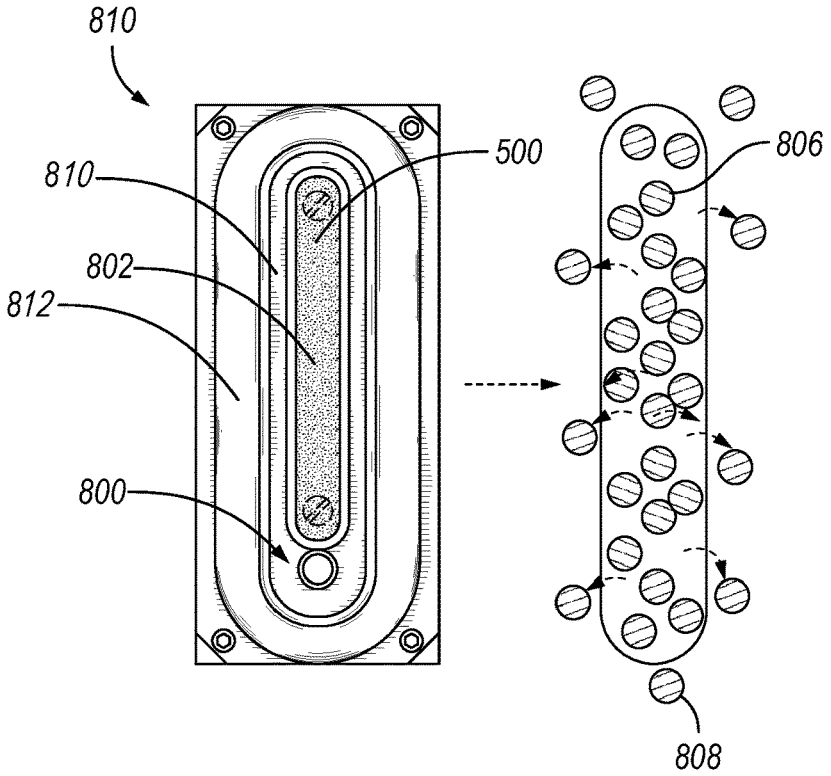
FIG. 8B illustrates an application of a wettability modifier coating to an oval sampling probe.

FIG. 8B illustrates another application of wettability modifier coating 500 to a sampling probe section 308. As illustrated in FIG. 8B, downhole tool 100 may comprise an oval sampling probe 810. Oval sampling probe 810 may be utilized in addition, or in place of focus sampling probe 809 in FIG. 8A. An oval sampling probe 810 is a large area probe that is oval shaped and communicates with a formation. As with a focused sampling probe 809, an oval sampling probe 810 may comprise a guard side 800 and a sample side 802. In examples, wettability modifier coating 500 may be applied to oval sampling probe 810, which may act as a repellent to repel unwanted fluids. As with FIG. 8A, wettability modifier coating 500 may be chosen to repel unwanted oil/water-based filtrate compounds 808 that may be disposed in oil-based fluids or water-based fluids 806. Thus, during sampling operations unwanted oil/water-based filtrate compounds 808 are repelled from oval sampling probe 810 by wettability modifier coating 500. In operation, pressure at sample side 802 may be reduced, thereby drawing in formation fluids from a surface of a borehole wall. In this manner, fluid samples may be collected and transported via flow line 323.

Figure 9A:
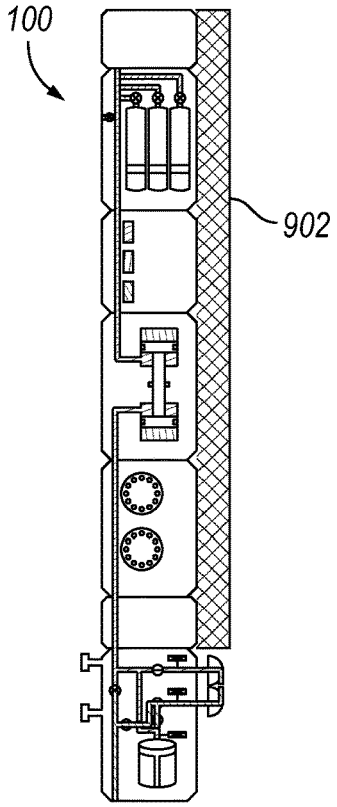
FIG. 9A illustrates a downhole tool having an external surface.

FIG. 9A illustrates a downhole tool 100 having an external surface 900. It should be understood that while external surface 900 is shown in FIG. 9A as being an external surface of downhole tool 100, that external surface 900 may alternatively comprise an external surface of any of the downhole tools previously described in this disclosure, or an external surface of any one or more specific modules of downhole tool 100 or other downhole tool.

Figure 9B:
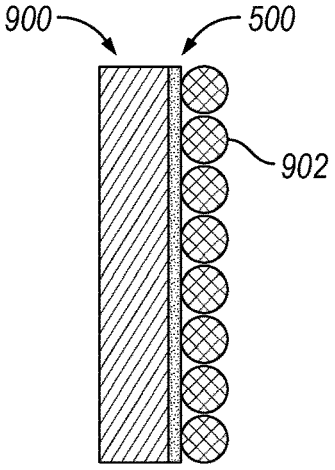
FIG. 9B illustrates a wettability modifier coating applied to an external surface of a downhole tool.

FIG. 9B illustrates wettability modifier coating 500 applied to external surface 900 of downhole tool 100. As discussed above, during operations, downhole tool 100 may be disposed in wellbore 104 (e.g., referring to FIG. 1). Tool sticking is a common concern of running downhole tool 100 in water or oil-based mud and occurs when a tool or tool string cannot be moved, rotated, or reciprocated along an axis of a wellbore. Conventional solutions to the problem of tool sticking typically consist of placing a small volume or pill of a spotting fluid, usually an oil-based mud, into a wellbore or wellbore annulus to free a stuck tool or pipe. However, by applying wettability modifier coating 500 to a surface 504 of downhole tool 100 at a terrestrial surface 112 prior to lowering downhole tool 100 down into wellbore 104, wellbore fluids 902, at a molecular level, may be prevented, at least in part, from sticking to downhole tool 100. This drastically reduces the risk of tool sticking of a tool string, tool, or wireline in muds and sands that may attach, for example, to downhole tool 100. This may also reduce the risk of a tool string or tool from becoming differentially stuck in a wellbore or borehole.

As mentioned, embodiments of the present disclosure may be operable to mitigate problems associated with tool sticking. During operation of a downhole tool 100, downhole tool 100 may be subject to tool sticking when exposed to wellbore fluids in wellbore 104. Such exposure may occur, for example, during lowering or raising of downhole tool 100 between measurement locations, such as between a first measurement location and a second location, or between a second measurement location and a third measurement location. Additionally, or alternatively, such exposure may occur during operation of downhole tool 100 while, for example, downhole tool 100 is carrying out an intended function of downhole tool 100. An intended function of downhole tool 100 may vary depending on the type of tool used, however an intended function may comprise, without limitation, performing one or more measurements of a wellbore fluid or formation, sampling a wellbore fluid, acoustic sensing, NMR sensing, in-situ calibrating, position sensing, optical sensing, assessing contamination of a wellbore fluid, fluid characterization, corrosion detection, pipe inspection, logging, logging-while-drilling, multi-sub and single-sub resistivity sensing, bed boundary detection, imaging, borehole imaging, borehole wall imaging, formation imaging, sensing of dielectric properties, differential voltage sensing, pulsed neutron sensing, inductive sensing, impedance sensing, tool anchoring, core sampling, pump-down, pump-out, telemetry, fluid placement, crown plug pulling, cement evaluating, steering, pressure steering, rotary steering, nuclear density sensing, well stimulation, look-ahead and look-around, fluid clearance, casing clearance, milling, cutting, intervention, the like, and any combination thereof. Wettability modifier coating 500 may enhance the operability of downhole tool 100 to perform its intended function by mitigating problems associated with such exposure. In addition, wettability modifier coating 500 may mitigate these same or similar problems when a conveyance undergoes exposure to wellbore fluids in wellbore 104. For example, while FIG. 9A shows and describes wettability modifier coating 500 as being disposed on an external surface of a downhole tool 100, FIGS. 10A and 10B show wettability modifier coating 500 as being additionally or alternatively disposed on a conveyance.

Figure 10A:
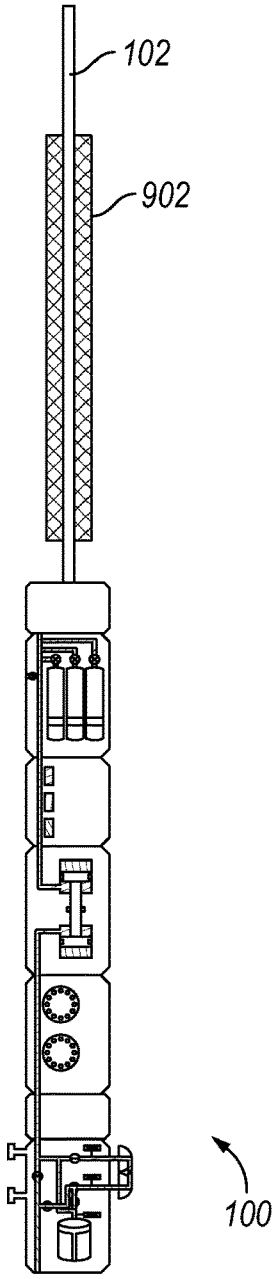
FIG. 10A illustrates a downhole tool attached to a conveyance.

FIG. 10A illustrates downhole tool 100 attached to conveyance 102. As illustrated, conveyance 102 may be attached or coupled to a downhole tool 100. Alternatively, conveyance 102 may be attached to any suitable downhole tool, such as any of the downhole tools previously described throughout this disclosure. Suitable downhole tools may include wireline tools or fluid sampling tools. As mentioned, during lowering or raising of a downhole tool 100 or operating of a downhole tool 100, downhole tool 100 may be exposed to a wellbore fluid 902. In addition, a conveyance 102 operably coupled to downhole tool 100 may also be exposed to a wellbore fluid 902. In one or more embodiments, it may be desirable to reduce or prevent conveyance 102 from sticking to a borehole wall, wellbore wall, or from otherwise interacting with wellbore fluid 902. For example, key seating is a common problem associated with raising and lowering a wireline into and out of a wellbore or borehole. In embodiments where conveyance 102 comprises a wireline, key seating may be reduced or prevented by decreasing an amount of friction exerted on a casing, borehole wall, wellbore wall, or contact area due to a repelling of a wireline from a contact surface on a molecular level using a wettability modifier coating 500. Reduction in an amount of key seating by a conveyance 102 having wettability modifier coating 500 applied to a surface thereof may be greater than about 1%, greater than about 5%, greater than about 10%, or greater than about 15% when compared to the same conveyance 102 without the wettability modifier coating 500 as judged by a depth of the key seat.

Figure 10B:
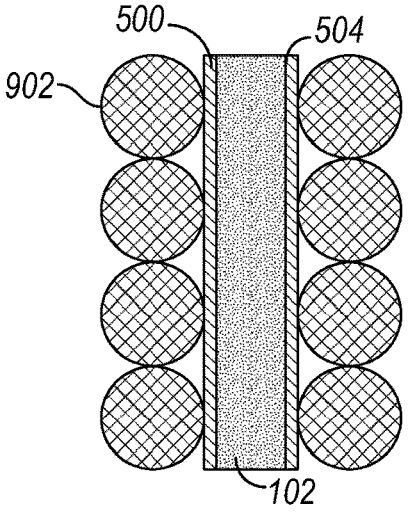
FIG. 10B illustrates a wettability modifier coating applied to a conveyance.

FIG. 10B illustrates conveyance 102. As illustrated, conveyance 102 is coated with wettability modifier coating 500. Conveyance 102 may comprise a tool string, drill string, or a wireline, to use non-limiting examples. Conveyance 102 may also comprise any continuous or disjointed tubing, or alternatively, noncontinuous or jointed tubing. In one or more examples, conveyance 102 may be configured to convey a tool from a surface location to a downhole location. As discussed above, during operations, downhole tool 100 may be raised or lowered into wellbore 104 (e.g., referring to FIG. 1) utilizing conveyance 102. As illustrated, wettability modifier coating 500 may be disposed between wellbore fluids 902 and conveyance 102 and may be operable to reduce or eliminate interactions between a surface 504 of conveyance 102 and wellbore fluids 902. While shown as individual particles, wellbore fluids 902 may instead be substituted with a contact surface area, such as a surface area of a wall of a wellbore or borehole, or a casing. Wettability modifier coating 500 may decrease a coefficient of friction between conveyance 102 and wellbore fluid 902, thereby mitigating problems associated with sticking and/or key seating.

Figure 10C:
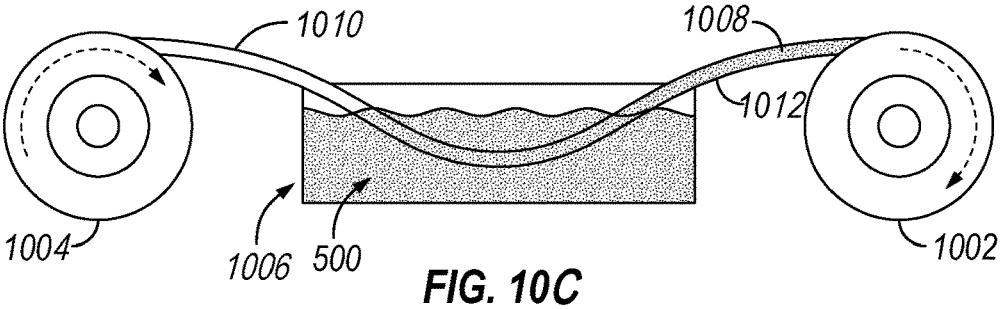
FIG. 10C illustrates the application of a wettability modifier coating to a conveyance.

FIG. 10C illustrates a method of applying a wettability modifier coating 500 to a downhole tool string 1008. As mentioned, conveyance 102 may comprise a tool string. It should be understood that the principles taught with respect to downhole tool string 1008 may be applied to conveyance 102. In FIG. 10C, wettability modifier coating 500 may be applied to a downhole tool string 1008 by moving downhole tool string 1008 through a vat 1006 of wettability modifier coating 500. This may be performed by spooling downhole tool string 1008 from a first spool 1002 to a second spool 1004. It is noted that in one or more example, tool string 1008 may comprise continuous or disjointed tubing. In use, spools 1002 and 1004 may turn to unwrap, feed, and wrap downhole tool string 1008 around spools 1002 and 1004, thereby exposing an external surface 1010 thereof to wettability modifier coating 500 disposed in vat 1006. Spooling may be performed with a drum pulley (not shown). Alternatively, or additionally, spooling may be performed with a drive motor and/or reelable assembly configured or operable to spool and unspool downhole tool string 1008. A reelable assembly generally comprises at least one spool operable to spool and unspool downhole tool string 1008. A reelable assembly may also comprise a drive motor and/or a drum pulley for spooling and unspooling downhole tool string 1008. Upon application, a wettability modifier residue of uniform, approximately uniform, or uneven thickness is adhered to an external surface 1010 of downhole tool string 1008 to form a film 1012. Film 1012 may comprise a wettability modifier coating 500. In certain examples, after spooling through vat 1006, film 1012 may optionally be dried, such as with a heat blower or air dried prior to spooling onto 1002. In certain examples, a maintenance procedure is performed on downhole tool string 1008 prior to application of film 1012 to clean and remove any residual contamination left over from exposure to formation fluids in a wellbore during an operation, or to remove any debris, particulates, films, or contamination from external surface 1010. Any suitable procedure for assessing whether or not film 1012 is applied with a satisfactory thickness and/or thickness distribution may be used. One suitable technique to assess proper placement of film 1012 is to measure a contact angle as previously described. In one or more examples, if film 1012 has been properly applied to external surface 1010, a visually observable droplet bead will from when an oleaginous or water-based fluid is applied to external surface 1010. Likewise, in certain examples, if film 1012 has not been applied satisfactorily, a visually observable smearing of fluid will occur, and the visually observable droplet bead will not form. In one or more examples, downhole tool string 1008 may simply be lowered into vat 1006, or be otherwise submerged, either wholly or partially, in wettability modifier coating 500. Alternatively, wettability modifier coating 500 may be layered onto downhole tool string 1008 using any suitable method, such as by any of the techniques herein provided for application of wettability modifier coating 500 to surface 504.

Figure 11:
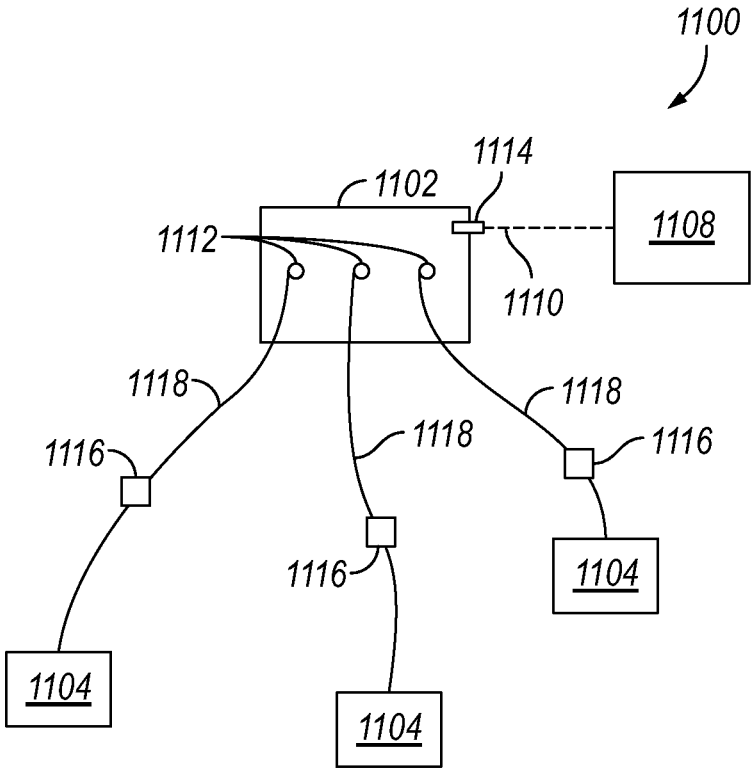
FIG. 11 illustrates a system for disposing a wettability modifier coating on one or more internal or external surfaces of a downhole tool, in accordance with certain examples.

In other examples, wettability modifier coating may be pumped through or over an internal or external surface of a downhole tool. FIG. 11 illustrates a system 1100 for disposing wettability modifier coating 500 on one or more internal or external surfaces of a tool 1104. Tool 1104 may comprise any of the downhole tools described herein. As illustrated, in one or more examples, wettability modifier coating 500 is applied to an internal surface (or external surface) of a tool 1104 by pumping, as mentioned. An internal or external surface of tool 1104 may comprise surface 504. In these examples, pumping may be performed using a variety of techniques. For example, pumping of an application fluid through an internal flowline or area of a tool may be achieved using one or more pumps 1116. Pumps 1116 may comprise a hydraulic pump, such as a hydraulic hand pump (e.g., Enerpac® Hydraulic Hand Pump), or an electric pump (e.g., positive-displacement pump, centrifugal pump, axial-flow pump). Where used, an electric pump may have a horsepower from about 0.01 HP to about 2 HP. Alternatively, from about 0.01 HP to about 0.5 HP, about 0.5 HP to about 1 HP, about 1 HP to about 1.5 HP, about 1.5 HP to about 2 HP, or any ranges therebetween.

In one example, an application fluid may be stored in a storage container 1102 fluidically coupled to pump 1116, where pumping may draw application fluid from one or more outlets 1112 of storage container 1102 and force it through or over one or more internal and/or external regions of tool 1104 having a surface 504. Fluidical coupling of storage container 1102 to pump 1116 and/or tool 1104 may be achieved with a flexible conduit 1118 (e.g., flexible hose). Alternatively, fluidical coupling of storage container 1102 to a pump 1116 and/or tool 1104 may be achieved with a more rigid conduit. Optionally, storage container 1102 may be fluidically coupled to an application fluid source 1108. An inlet 1114 may be used to fluidically couple storage container 1102 to application fluid source 1108. Application fluid source 1108 may be a vat filled with wettability modifier coating 500, a pipeline supply of wettability modifier coating 500, or the like. In one or more examples, pumping by each one or more pumps 1116 is performed with a stationary pump, such as a stationary hydraulic pump. In these examples, a stationary pump may be bolted or otherwise fixed at a surface location. In some examples, a stationary pump and/or storage container may be bolted or otherwise fixed to a mobile apparatus, such as a cart with wheels, thereby allowing for ease of access to wettability modifier coating 500 at a variety of locations. In some examples, storage container 1102 may have a plurality of outlets 1112, thereby allowing for simultaneous pumping of an application fluid from storage container 1102 to a plurality of surfaces 504 using multiple pumps 1116. In multiple-pump-examples, a plurality of surface 504 may comprise multiple internal and/or external regions of a single tool 1104, or multiple internal and/or external regions of a plurality of tools 1104.

In pumping examples, during pumping of an application fluid through and/or over surface 504 of a tool at a surface location, wettability modifier coating 500 may adhere to a surface 504 to form wettability modifier coating 500. After application of an application fluid to surface 504, any unused application fluid which did not adhere to surface 504 may be discarded as waste or recycled to storage container 1102. Recycling may be performed using an additional flexible or rigid conduit (not shown) fluidically connecting surface 504 back to storage container 1102. In one or more examples, recycled application fluid may pass through one or more filters (not shown) prior to re-entering storage container 1102 to substantially remove any unwanted particulates or other unwanted materials inadvertently absorbed by an application fluid during pumping, such as one or more contaminants previously adhered to an internal and/or external surface of a tool.

In addition to, or as an alternative to pumping of an application fluid over or through a surface 504, other techniques may be used to form a wettability modifier coating 500 on a surface 504. To further illustrate these and other techniques which may be suitable for applying a wettability modifier coating 500 to a surface 504, a workflow 1200 is provided.

Figure 12:
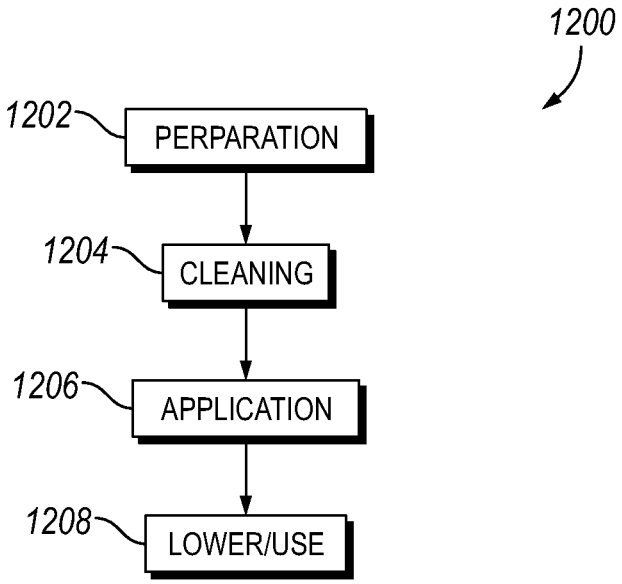
FIG. 12 is a workflow of an application of a wettability modifier to a surface.

FIG. 12 illustrates a workflow for applying a wettability modifier coating 500 to a surface 504. As illustrated, workflow 1200 may comprise a number of blocks 1202, 1204, 1206, and 1208. While shown sequentially, it should be understood that any of blocks 1202, 1204, 1206, and 1208 may be rearranged as needed to suit a particular application. However, in general, unapplied wettability modifier may be prepared in preparation block 1202. Unapplied wettability modifier may comprise an application fluid and be in a liquid phase. Unapplied wettability modifier may comprise one or more compositional elements including any of the species herein disclosed. An application fluid comprising unapplied wettability modifier may comprise one or more compositional elements, which may be at least partially dissolved in a carrier fluid. Alternatively, an application fluid may comprise one or more compositional elements without a carrier fluid. A carrier fluid may comprise water, solvent, or any suitable carrier fluid. Preparation block 1202 may comprise disposing an application fluid comprising an unapplied wettability modifier in vat 1006 (e.g., referring to FIG. 10). Alternatively, preparation block 1202 may comprise preparing one or more wipes, as previously mentioned, with an application fluid comprising an unapplied wettability modifier. Preparing unapplied wettability modifier for eventual application to a surface may be a multi-stage process depending on the formulation of wettability modifier. In one or more embodiments, one or more compositional elements may be mixed and/or blended together until a concentration of one of the one or more compositional elements reaches a prespecified threshold. Preparation step 1202 may additionally comprise a heating step, wherein an application fluid comprising an unapplied wettability modifier is brought to a prespecified temperature and/or pressure. Preparation step 1202 may alternatively comprise vaporizing of one or more compositional elements which make up an unapplied wettability modifier for eventual application in block 1206 as wettability modifier coating 500. Referring to FIG. 10C, an application fluid comprising unapplied wettability modifier and/or one or more compositional elements may comprise wettability modifier coating 500, which may be prepared in vat 1006. Alternatively, an application fluid may be prepared at a separate location and later introduced to or disposed in vat 1006.

In block 1204, surface 504 (e.g., referring to FIG. 5) may be cleaned in preparation for application of unapplied wettability modifier thereto to form wettability modifier coating 500. As discussed previously, surface 504 may refer to a number of inner or external surfaces disposed on various tool types, strings, and/or conveyances. Cleaning in block 1204 may comprise shaking, washing, scrubbing, spraying, dissolution, or removal of contaminants, and/or any suitable technique for removing unwanted materials from a surface. For example, and with reference to FIG. 10C where surface 504 is an external surface 1010 of a downhole tool string 1008, downhole tool string 1008 may be passed through a series of one or more cleaning vats (not shown) such that unwanted wellbore fluids adhered to surface 504 may be at least partially, completely, or substantially removed prior to introduction to vat 1006. For example, downhole tool string 1008 may pass through one or more cleaning vats before or after spooling through spool 1004 and prior to spooling through spool 1002. One or more cleaning fluids such as water may be disposed within a cleaning vat. Over time, cleaning fluid disposed in a cleaning vat may need to be replaced as wellbore fluids adhered to surface 504 are removed and may be replaced continuously or in batches. Likewise, application fluid may be continuously replaced or replaced in batches. Once surface 504 is clean, preparation block 1204 may additionally comprise an optional drying step wherein surface 504 is allowed to dry prior to proceeding to block 1206. As previously mentioned, drying in block 1204 may occur with one or more heat blowers.

In block 1206, unapplied wettability modifier is applied to surface 504 to form wettability modifier coating 500. Prior to application of unapplied wettability modifier to surface 504, surface 504 may have a number of adsorption sites cleared as a result of cleaning in block 1204. For example, an average percentage of adsorption sites free of contaminants by wellbore fluids for a number of available adsorption sites of a given surface area of surface 504 may be greater than 75%, greater than 80%, greater than 85%, greater than 90%, greater than 95%, or greater than 99% prior to introduction to block 1206.

With continued reference to block 1206, application fluid formed or obtained in block 1202 comprising unapplied wettability modifier is applied to a cleaned surface 504. Alternatively, unapplied wettability modifier may be applied to surface 504 without a cleaning step. Yet alternatively, application of wettability modifier in block 1206 may double as both an application step and a cleaning step. The particular configuration of workflow 1200 may vary depending on the type of surface to which unapplied wettability modifier is applied. For example, a workflow for applying a wettability modifier coating 500 to an internal surface of a fluid sampling tool may differ from a workflow for applying a wettability modifier coating 500 to an external surface of a conveyance 102. Application fluid comprising unapplied wettability modifier coating 500 may be contacted with surface 504. Contacting of an application fluid comprising wettability modifier coating 500 with surface 504 may occur at a terrestrial surface 112 (e.g., referring to FIGS. 1 and 2). In addition, contacting of an application fluid with surface 504 may be achieved by any requisite machinery for ensuring good contact with surface 504. Moreover, it is noted that while application fluid is shown as a liquid disposed in vat 1006 (e.g., referring to FIG. 10C), application fluid may alternatively be in a vapor phase at a time of contact with surface 504, such as when a vapor deposition technique is used.

Once contact between an application fluid comprising unapplied wettability modifier is allowed to occur for a sufficient duration of time, a wettability modifier coating 500 may form on surface 504 (e.g., referring to FIGS. 5A and 5B). Sufficient duration of time may depend on exposure and/or curing conditions of an application fluid but may be in a range from about 0.01 seconds to about 10,000 seconds. Alternatively, from about 0.01 seconds to about 15 seconds, about 15 seconds to about 30 seconds, about 30 seconds to about 60 seconds, about 60 seconds to about 120 seconds, about 120 seconds to about 500 seconds, about 500 seconds to about 1000 seconds, about 1000 seconds to about 3600 seconds, about 3600 seconds to about 10,000 seconds, or any ranges therebetween. Wettability modifier coating 500 may comprise film 1012 (e.g., referring to FIG. 10C). Once formed, wettability modifier coating 500 may be operable to repel unwanted wellbore fluids, as previously discussed.

In block 1208, a tool or tool string to which wettability modifier coating 500 is applied may be lowered into a wellbore or borehole, wherein a tool may perform its intended function. Lowering, using, and/or raising of a tool or tool string in a wellbore may permit exposure of wellbore fluids to wettability modifier coating 500 now applied to surface 504. As discussed, wettability modifier coating 500 may be operable to repel unwanted fluids and contaminants, thereby allowing for ease of use. For example, each of lowering, using, and raising of a tool or tool string in a wellbore may be enhanced by wettability modifier coating 500. While a tool or tool string are herein described with respect to block 1208, it should be understood that any of the components comprising surface 504 may be used in block 1208.

Accordingly, the present disclosure may provide wettability modifier coatings for disposal on a downhole tool. Such wettability modifier coatings represent a number of improvements to existing tools including, without limitation, a reduction in a susceptibility of a tool or tool string to tool sticking, reduced likelihood of key seating of a tool string or wireline, increased rapidity of lowering and/or raising of a tool string in a wellbore or borehole, a decreased amount of drag of a tool or tool string in a wellbore fluid, improved accuracy of sensing through sensing regions upon which the wettability modifier coating is disposed, reduced amount of time and volume of cleaner fluid to clean a tool or tool string, increased fluid velocity of fluids through internal passageways disposed in a tool, improved accuracy of sensor measurements, as well as anti-smudging, anti-fouling, anti-fog, and/or self-cleaning capabilities. The methods may include any of the various features disclosed herein, including one or more of the following statements.

Statement 1: A method that may comprise applying a wettability modifier coating on a surface of a downhole tool and disposing the downhole tool into a wellbore extending into a subterranean formation, wherein the wettability modifier coating is disposed on the surface of the downhole tool. The method may further comprise traversing the wellbore with the downhole tool; and removing the downhole tool from the wellbore.

Statement 2: The method of statement 1, wherein the wettability modifier coating comprises an oleophobic layer, a hydrophobic layer, or both.

Statement 3: The method of statement 1 or statement 2, wherein the surface is an external surface of the downhole tool.

Statement 4: The method of any previous statement, wherein the surface is an internal surface of the downhole tool.

Statement 5: The method of any previous statement, wherein the surface is an internal surface of one or more flow lines disposed within the downhole tool.

Statement 6: The method of statement 5, wherein the applying comprises pumping the wettability modifier coating through the one or more flow lines with one or more pumps.

Statement 7: The method of any previous statements 1-4, wherein the surface is a viewing region of an optical measurement tool.

Statement 8: The method of statement 7, wherein the surface is a sapphire surface of the viewing region of the optical measurement tool.

Statement 9: The method of any previous statements 1-4 or 7, wherein the applying comprises dip coating.

Statement 10: The method of any previous statements 1-4, 7, or 9, wherein the applying comprises spray coating.

Statement 11: The method of any previous statements 1-4, 7, 9, or 10, wherein the applying comprises a vapor deposition.

Statement 12: The method of any previous statements 1-4, 7, or 9-11, wherein the surface upon which the wettability modifier coating is disposed has an oil contact angle of at least 75 degrees and a water contact angle of at least 105 degrees.

Statement 13: The method of any previous statements 1-4, 7, or 9-12, wherein the surface is a probe face.

Statement 14: The method of any previous statements 1-4, 7, or 9-13, wherein the wettability modifier coating comprises at least one wettability modifier selected from the group consisting of silicone, siloxane, silane, fluorosilane, organosilicone, polytetrafluoroethylene and any combination thereof.

Statement 15: The method of any previous statements 1-4, 7, or 9-14, wherein the wettability modifier coating comprises at least one wettability modifier selected from the group consisting of propylene glycol propyl ether, 1-propoxy-2-propanol, ethyl nonafluoroisobutyl ether, ethyl nonafluorobutyl ether, and any combination thereof.

Statement 16: The method of any previous statements 1-4, 7, or 9-15, further comprising preventing, at least in part, adsorption of a contaminant to one or more adsorption sites of the surface, wherein the contaminant comprises at least one contaminant selected from the group consisting of an asphaltene, a carboxylate, clay, shale, an organic foulant, sand, and any combination thereof.

Statement 17: A method may comprise applying a wettability modifier coating on a first surface of a downhole tool and applying the wettability modifier coating on a second surface of a conveyance. The method may further comprise attaching the conveyance to the downhole tool and disposing the downhole tool into a wellbore extending into a subterranean formation, wherein the wettability modifier coating is disposed on the first surface and the second surface. The method may further comprise traversing the wellbore with the downhole tool and removing the downhole tool from the wellbore.

Statement 18: The method of claim 17, wherein the applying of the wettability modifier coating on a second surface comprises spooling the conveyance in the wettability modifier coating using a drum pulley or a drive motor.

Statement 19: The method of statement 17 or statement 18, wherein the applying of the wettability modifier coating on the first surface or the second surface comprises at least one application technique selected from the group consisting of: spray coating, dip coating, vapor deposition, line of sight deposition, casting, immersion, and any combinations thereof.

Statement 20: The method of statement 17, statement 18, or statement 19, wherein the conveyance is a tool string.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method comprising:

applying a wettability modifier coating to an external surface of a wireline for a downhole tool, wherein the applying comprises:

drawing the wireline with a drum pulley between a first spool and a second spool through a vat containing the wettability modifier coating to expose the external surface of the wireline to the wettability modifier coating;

disposing the downhole tool via the wireline into a wellbore extending into a subterranean formation, wherein the wettability modifier coating is disposed on at least the external surface of the wireline;

traversing the wellbore with the downhole tool, wherein the wettability modifier coating reduces friction to thereby prevent or mitigate sticking and/or key seating of the wireline in the wellbore; and removing the downhole tool from the wellbore.

2. The method of claim 1, wherein the wettability modifier coating comprises an oleophobic layer, a hydrophobic layer, or both.

3. The method of claim 1, further comprising applying the wettability modifier coating to one or more external surfaces of the downhole tool.

4. The method of claim 1, further comprising applying the wettability modifier coating to one or more internal surfaces of the downhole tool.

5. The method of claim 4, wherein the one or more internal surfaces of the downhole tool comprise one or more internal surfaces of one or more flow lines disposed within the downhole tool.

6. The method of claim 5, wherein the applying the wettability modifier coating to the one or more internal surfaces of the downhole tool comprises pumping the wettability modifier coating through the one or more flow lines with one or more pumps.

7. The method of claim 3, wherein the one or more external surfaces of the downhole tool comprises a viewing region of an optical measurement tool.

8. The method of claim 7, wherein the viewing region comprises a sapphire surface of the optical measurement tool.

9. The method of claim 1, wherein the external surface of the wireline upon which the wettability modifier coating is disposed has an oil contact angle of at least 75 degrees and a water contact angle of at least 105 degrees.

10. The method of claim 3, wherein the one or more external surfaces comprise one or more probe faces of one or more probes.

11. The method of claim 1, wherein the wettability modifier coating comprises at least one wettability modifier selected from the group consisting of silicone, siloxane, silane, fluorosilane, organosilicone, polytetrafluoroethylene and any combination thereof.

12. The method of claim 1, wherein the wettability modifier coating comprises at least one wettability modifier selected from the group consisting of propylene glycol propyl ether, 1-propoxy-2-propanol, ethyl nonafluoroisobutyl ether, ethyl nonafluorobutyl ether, and any combination thereof.

13. The method of claim 1, further comprising preventing, at least in part, adsorption of a contaminant to one or more adsorption sites with the wettability modifier coating, wherein the contaminant comprises at least one contaminant selected from the group consisting of an asphaltene, a carboxylate, clay, shale, an organic foulant, sand, and any combination thereof.

14. The method of claim 1, wherein the wettability modifier coating comprises one or more surfactants and water.

15. The method of claim 14, wherein the one or more surfactants are present in the wettability modifier coating from about 0.01 wt. % to about 5 wt. %, or any ranges therebetween.

16. The method of claim 3, wherein the one or more external surfaces comprise at least one of: a viewing window; a power telemetry section; a multi-chamber section; a fluid density module; a fluid sampling probe; a dual probe section; a stabilizer, an enhanced probe section; a detector; and any combination thereof.

17. The method of claim 4, wherein the one or more internal surfaces comprise a surface of at least of: a viewing window; a sample container; a power telemetry section; a multi-chamber section; a fluid density module; a bidirectional pump; an optical measurement tool; a light source; an optical sensor; an optical plate; a low-volume bidirectional piston; a hi-volume bidirectional pump; an optical filter; a detector; a filter bank; a fluid conduit; and any combination thereof.

18. A method comprising:

applying a wettability modifier coating to one or more internal and/or external surfaces of a downhole tool;

applying the wettability modifier coating on an external surface of a wireline by drawing the wireline with a drum pulley between a first spool and a second spool through a vat containing the wettability modifier coating to expose the external surface of the wireline to the wettability modifier coating, whereby friction of the external surface is reduced by the wettability modifier coating;

attaching the conveyance to the downhole tool;

disposing the downhole tool into a wellbore extending into a subterranean formation, wherein the wettability modifier coating is disposed on the internal and/or external surfaces of the downhole tool and the external surface of the wireline;

traversing the wellbore with the downhole tool wherein the wettability modifier coating reduces friction to thereby prevent or mitigate sticking and/or key seating of the wireline in the wellbore; and removing the downhole tool from the wellbore.

19. The method of claim 18, wherein the applying of the wettability modifier coating to one or more internal and/or external surfaces of the downhole tool comprises at least one application technique selected from the group consisting of: spray coating, dip coating, vapor deposition, line of sight deposition, casting, immersion, wiping, and any combinations thereof.

* * * * *